US008182058B2

(12) United States Patent
Itoh

(10) Patent No.: US 8,182,058 B2
(45) Date of Patent: May 22, 2012

(54) DOUBLE-SIDED RECORD APPARATUS AND DOUBLE-SIDED RECORD METHOD

(75) Inventor: Shingo Itoh, Komaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 12/382,171

(22) Filed: Mar. 10, 2009

(65) Prior Publication Data

US 2009/0195584 A1 Aug. 6, 2009

Related U.S. Application Data

(62) Division of application No. 10/797,131, filed on Mar. 11, 2004, now Pat. No. 7,520,586.

(30) Foreign Application Priority Data

Mar. 12, 2003 (JP) ..... 2003-067063

(51) Int. Cl.
*B41J 29/38* (2006.01)

(52) U.S. Cl. ..... 347/14; 347/19

(58) Field of Classification Search ..... 347/19, 347/14

See application file for complete search history.

(56) References Cited

U.S. PATENT DOCUMENTS

| | | | | |
|---|---|---|---|---|
| 5,742,301 | A | 4/1998 | Ikeda | |
| 5,870,114 | A | 2/1999 | Numata et al. | |
| 6,307,981 | B1 | 10/2001 | Kamei et al. | |
| 6,578,944 | B1 | 6/2003 | Kamei et al. | |
| 6,652,060 | B2 | 11/2003 | Uchida | |
| 6,853,948 | B2 | 2/2005 | Jewell | |
| 6,938,974 | B2 | 9/2005 | Uchida | |
| 2001/0019345 | A1 | 9/2001 | Endo | |
| 2001/0050699 | A1 * | 12/2001 | Hickman | 347/37 |
| 2002/0145640 | A1 | 10/2002 | Anderson et al. | |
| 2002/0196300 | A1 * | 12/2002 | Takahashi et al. | 347/14 |
| 2003/0038870 | A1 | 2/2003 | Shimada | |
| 2003/0160852 | A1 | 8/2003 | Pickup | |

FOREIGN PATENT DOCUMENTS

| | | |
|---|---|---|
| JP | A 6-134982 | 5/1994 |
| JP | A-7-314734 | 12/1995 |
| JP | 2000141627 A * | 5/2000 |
| JP | A-2000-141627 | 5/2000 |
| JP | A 2001-063019 | 3/2001 |

(Continued)

OTHER PUBLICATIONS

Japanese Office Action with partial translation mailed Feb. 23, 2010 for Japanese Patent Application No. 2008-00470.

*Primary Examiner* — Laura Martin
(74) *Attorney, Agent, or Firm* — Oliff & Berridge, PLC

(57) ABSTRACT

A double-sided record apparatus for forming images on both sides of a recording medium. The double-sided record apparatus includes: a print head that moves relatively to the record medium and ejects ink onto a face of the record medium; a counting unit configured to count the number of ejected ink droplets to a predetermined area on the record medium from the print head; a comparison unit configured to compare the number of ejected ink droplets counted by the counting unit with a predetermined value; and a determination unit configured to determine whether double-sided record of the record medium is enabled based on a comparison result of the comparison unit.

6 Claims, 12 Drawing Sheets

FOREIGN PATENT DOCUMENTS

| | | | | |
|---|---|---|---|---|
| JP | A 2001-260485 | | | 9/2001 |
| JP | 2002314790 | A | * | 10/2002 |
| JP | 2003034021 | A | * | 2/2003 |
| JP | A 2003-048311 | | | 2/2003 |
| JP | A-2003-341033 | | | 12/2003 |
| JP | 2004017373 | A | * | 1/2004 |

* cited by examiner

DOUBLE-SIDED RECORD APPARATUS AND DOUBLE-SIDED RECORD METHOD

This is a Divisional of application Ser. No. 10/797,131 filed Mar. 11, 2004, which claims priority to Japanese Application No. 2003-067063 filed Mar. 12, 2003. The disclosure of the prior applications are hereby incorporated herein by reference in their entirety.

BACKGROUND OF THE INVENTION

1. Field of the Invention

The present invention relates to a double-sided record apparatus and a double-sided record method for forming an image on both sides of a record medium through a print head.

2. Background Art

Hitherto, a double-sided record apparatus, such as a printer or a copier, has been known for fixing ink to form an image on both sides of record paper (record medium) according to an ink jet technique for ejecting ink through a print head.

In such an ink jet record apparatus, the number of droplets or the ejection amount of ink ejected to the same pixel is changed to produce gray scale representation of an image, and ink is fixed as water content is evaporated into the air and the ink is absorbed into record paper. However, most ink is absorbed into record paper and therefore to print on both sides of record paper, if the ejection amount of ink is large, the image on the back may be seen through the paper from the top (back reflection), impairing the quality of the image. If the ejection amount of ink to record paper is large, a wrinkle may occur on the record paper and the record paper may jam in the transport passage in the record apparatus, preventing smooth transport.

Then, a liquid ejection record control apparatus (double-sided record apparatus) for setting enable or disable of double-sided record depending on the type of ink to be used (for example, light color or dark color) and the record mode (high-resolution or low-resolution mode) is available. That is, if the record mode is selected as high image quality and the type of ink to be used is light color in the double-sided record apparatus, the amount of ink ejected to record paper increases and back reflection easily occurs and thus double-sided record is switched to single-sided record so as to inhibit double-sided record and record only on one side. (For example, refer to JP-A-2000-141627 (p. 3-p. 4, FIGS. 1 to 4))

SUMMARY OF THE INVENTION

However, according to the liquid ejection record control apparatus described in JP-A-2000-141627, whether or not double-sided record is enabled is determined depending on the record mode and the type of ink. Thus, for various images, the presence or absence of back reflection cannot precisely be determined and whether or not double-sided record is enabled cannot effectively be determined; this is a problem.

That is, to execute color print with high resolution in the record mode, if level of the gray scale of the image to be formed on record paper is low and the ink ejection amount is small, it is feared that disable of double-sided record may be determined unnecessarily depending on the record mode and the type of ink.

To print with low resolution in the record mode, if the gradation of the image to be formed on record paper is high and the ink ejection amount is large, it is feared that enable of double-sided record may be determined by mistake depending on the record mode and the type of ink.

A double-sided record apparatus and a double-sided record method are disclosed herein, in which, to form images on both sides of record paper, the presence or absence of back reflection can be determined with accuracy for the images, whether or not double-sided record is enabled can be determined effectively, and high-quality images can be provided.

According to an aspect of the invention, a double-sided record apparatus for forming images on both sides of a recording medium, includes: a print head that moves relatively to the record medium and ejects ink onto a face of the record medium; a counting unit configured to count the number of ejected ink droplets to a predetermined area on the record medium from the print head; a comparison unit configured to compare the number of ejected ink droplets counted by the counting unit with a predetermined value; and a determination unit configured to determine whether double-sided record of the record medium is enabled based on a comparison result of the comparison unit.

According to this aspect, the number of ejected ink droplets to the predetermined area on the record medium can be counted and whether or not double-sided record of the record medium is enabled can be determined based on the number of ejected ink droplets. Thus, when ink is ejected to both sides of the record medium to form images, high-quality images can be provided on both sides of the record medium without impairing the image quality. To form an image on the record medium, the amount of ink ejected to the record medium is measured as the number of ejected ink droplets, so that the presence or absence of back reflection can be accurately determined for various images and whether or not double-sided record is enabled can be effectively determined.

According to another aspect of the invention, to record on a plurality of record media, the determination unit determines whether double-sided record of the record medium is enabled for each record medium.

According to this aspect, whether or not double-sided record of the record medium is enabled is determined for each record medium. Thus, double-sided record is determined for the record medium on which an image is formed without impairing the image quality, and single-sided record is determined for the record medium with the fear of impairing the image quality, so that whether or not double-sided record is enabled can be effectively determined for a plurality of record media.

According to another aspect of the invention, the counting unit is configured to count the number of ejected ink droplets to the predetermined area on each of both sides of the record medium.

According to this aspect, the number of ejected ink droplets to the predetermined area on each of both sides of the record medium is counted. Thus, when the number of ejected ink droplets exceeds the predetermined value on either side, it can be determined that double-sided record is disabled, and a high-quality image can be provided.

According to another aspect of the invention, when the number of ejected ink droplets exceeds the predetermined value as the comparison result of the comparison unit, the determination unit determines that double-sided record on the record medium is disabled.

According to this aspect, when the number of ejected ink droplets to the surface of the record medium is large, the ink printed on the surface of the record medium penetrates into the back of the record medium and if print is executed on the back of the record medium, the quality of the images printed on the surface and the back of the record medium is easily impaired. Thus, when the number of ejected ink droplets exceeds the predetermined value, record on the back of the record medium is disabled, whereby high-quality images can be provided.

According to another aspect of the invention, the print head forms an image on the first side of the record medium and then forms an image on the second side of the back of the first side of the record medium, thereby forming images on both sides of the record medium; and, when the print head forms an image on the first side of the record medium, the counting unit counts the number of ejected ink droplets to the predetermined area on the first side of the record medium through the print head.

According to this aspect, before an image is formed on the second side of the back of the first side, the number of ink droplets having been ejected to the first side is counted, so that whether or not record on the second side is enabled can be determined reliably.

According to another aspect of the invention, the print head forms an image on the first side of the record medium and then forms an image on the second side of the back of the record medium, thereby forming images on both sides of the record medium; and, before the print head forms an image on the first side of the record medium, the counting unit counts the number of ink droplets to be ejected to at least one of the predetermined area on the first side and the predetermined area on the second side.

According to this aspect, before an image is formed on the first side of the record medium, the counting unit counts the number of ink droplets to at least either of the predetermined area on the first side and the predetermined area on the second side. Thus, whether or not double-sided record is enabled can be determined before images are formed on the first side and the second side, and after an image is formed on the first side, image formation on the second side can be started early.

According to another aspect of the invention, the double-sided record apparatus further includes an area specification unit configured to specify the predetermined area; wherein the counting unit counts the number of ejected ink droplets to the predetermined area specified through the area specification unit.

According to this aspect, the predetermined area of the record medium in which the number of ejected ink droplets is counted can be previously specified and the number of ejected ink droplets to the specified predetermined area can be counted, so that the print area on the record medium and the area in which the number of ejected ink droplets is actually counted can be matched with each other for effectively determining whether or not double-sided record of the record medium is enabled.

According to another aspect of the invention, the area specification unit specifies one page of the record medium as the predetermined area.

According to this aspect, one page of the record medium can be specified as the predetermined area in which the number of ejected ink droplets is counted. Thus, to form images continuously on two or more record media, high-quality images can be provided with uniform image quality.

According to another aspect of the invention, the area specification unit specifies as the predetermined area an area where the print head moves within one pass in a predetermined direction relative to the record medium.

According to this aspect, an area in which the print head moves only in one pass in a predetermined direction relative to the record medium can be specified as the area in which the number of ejected ink droplets is counted. Thus, a high-quality image can be provided without impairing the image quality because of local osmosis of ink into the record medium.

According to another aspect of the invention, the area specification unit specifies as the predetermined area an area where the print head moves relative to the record medium within a predetermined time.

According to this aspect, an area in which the print head moves within a predetermined time relative to the record medium can be specified as the predetermined area in which the number of ejected ink droplets is counted. When the ejected ink amount per predetermined time is imbalancedly large, the volatile component in the ink does not sufficiently evaporate into the air and the ink is easily absorbed in the record medium. Thus, the area in which the print head moves within the predetermined time is specified as the area in which the number of ejected ink droplets is counted, so that whether or not double-sided record is enabled can be determined with accuracy and when double-sided record is executed, high-quality images can be provided without impairing the image quality.

According to another aspect of the invention, the area specification unit specifies as the predetermined area an area in which the print head moves a predetermined distance in a predetermined direction relative to the record medium.

According to this aspect, an area in which the print head moves only a predetermined distance in a predetermined direction relative to the record medium can be specified as the predetermined area in which the number of ejected ink droplets is counted. Thus, for each predetermined-distance area in the predetermined direction, the record area on the record medium and the area in which the number of ejected ink droplets is actually counted can be matched with each other for effectively determining whether or not double-sided record of the record medium is enabled.

According to another aspect of the invention, the determination unit determines that double-sided record on the record medium is disabled when an area exceeding a predetermined record density representing the number of ejected ink droplets per predetermined unit area on the record medium exceeds a given value.

According to this aspect, if the number of ejected ink droplets to the surface of the record medium is large and the area exceeding the predetermined record density exceeds the given value, the image quality is impaired. Thus, when the area exceeding the predetermined record density (the ratio of the number of actually ejected ink droplets to the number of ejected ink droplets per unit area) exceeds the given value, it is determined that double-sided record is disabled, so that a high-quality image can be provided without impairing the image quality because of local osmosis of ink.

According to another aspect of the invention, the double-sided record apparatus, further includes: a second-side counting unit configured to count the number of ejected ink droplets to a second side of the record medium before print on the second side of the record medium; and a cancel unit configured to cancel execution of record on both sides of the record medium based on the number of ejected ink droplets counted by the second-side counting unit when the determination unit determines that double-sided record on the record medium is enabled.

According to this aspect, the number of ejected ink droplets to the second side of the record medium is counted and execution of record on the second side can be canceled based on the number of ejected ink droplets. Thus, impairing the quality of the images on both sides of the record medium as the number of ejected ink droplets to the second side is large is prevented.

According to another aspect of the invention, the double-sided record apparatus, further includes: a reversal unit that reverses the record medium to record on both sides of the record medium from a given direction; wherein, when the determination unit determines doubled-sided record of the record medium to be disabled, the reversal unit does not reverse the record medium.

According to this aspect, if doubled-sided print of the record medium is not performed, the record medium is not reversed, so that the load for reversing the record medium is not imposed on the record medium or the double-sided record apparatus and smooth print operation is accomplished.

According to another aspect of the invention, the double-sided record apparatus, further includes: a recognition unit configured to recognize a type of record medium; and an invalidation unit configured to invalidate the determination of the determination unit based on the type of record medium recognized by the recognition unit; wherein double-sided record is executed when a double-sided record command is provided and the invalidation unit invalidates the determination of the determination unit.

According to this aspect, for example, if a record medium dedicated to double-sided print capable of suppressing osmosis of ink is used, even if the number of ejected ink droplets is large, high-quality images can be provided on both sides of the record medium. Thus, the invalidation unit for invalidating the determination of the determination unit according to the type of record medium, whereby high-quality images can be efficiently formed on both sides of the record medium conforming to the type of record medium.

According to another aspect of the invention, the double-sided record apparatus further includes: a recognition unit configured to recognize a type of record medium; and a count stop unit configured to stop an operation of the counting unit based on the type of record medium recognized by the recognition unit; wherein double-sided record is executed when a double-sided record command is provided and the count stop unit stops an operation of the counting unit.

According to this aspect, for example, if a record medium dedicated to double-sided print capable of suppressing osmosis of ink is used, even if the number of ejected ink droplets is large, high-quality images can be provided on both sides of the record medium. Thus, based on the type of record medium, it is assumed that double-sided record can be executed regardless of the number of ejected ink droplets, and the operation of the counting unit is stopped, whereby the load for counting the number of ejected ink droplets can be decreased.

According to another aspect of the invention, double-sided record is executed when the invalidation unit invalidates the determination of the determination unit, regardless of the comparison result.

According to this aspect, if the invalidation unit invalidates the determination of the determination unit, even if the number of ejected ink droplets exceeds the predetermined value as the comparison result of the comparison unit, it can be determined that record is executed on both sides of the record medium. Thus, if the number of ejected ink droplets exceeds the predetermined value, record can be executed on both sides based on the type of record medium.

According to another aspect of the invention, the double-sided record apparatus, further includes: a record medium type input unit to enter the type of record medium; wherein the recognition unit recognizes the type of record medium based on the type of record medium entered through the record medium type input unit.

According to this aspect, the recognition unit for recognizing the type of record medium can recognize the type of record medium based on the type of record medium entered by the user. Thus, the determination of the determination unit can be invalidated or record on both sides of the record medium can be executed based on user's intention regardless of whether the number of ejected ink droplets to the record medium is large or small.

According to another aspect of the invention, the double-sided record apparatus, further includes: a reception unit that receives identification information indicating the type of record medium over a communication line; wherein the recognition unit recognizes the type of record medium based on the identification information received by the reception unit.

According to this aspect, the recognition unit for recognizing the type of record medium can receive identification information indicating the type of record medium over a communication line and recognize the type of record medium. Thus, if the user does not previously know the type of record medium, the type of record medium can be recognized.

According to another aspect of the invention, the double-sided record apparatus, further includes: a detection unit that detects the type of record medium; wherein the recognition unit recognizes the type of record medium based on the detection result of the detection unit.

According to this aspect, the double-sided record apparatus also includes the detection unit for detecting the type of record medium, if the user does not previously keep track of information indicating the type of record medium, the type of record medium can be detected and record can be executed conforming to the type of record medium.

According to another aspect of the invention, the detection unit includes a reflection optical sensor having a light emission element and a light reception element; and, when the light emission element emits light to the record medium and the light reception element receives reflected light from the record medium, the detection unit recognizes the type of record medium based on the light reception amount of the light reception element.

According to this aspect, when light is applied from the light emission element to the record medium, reflected light varies depending on the type of record medium. Thus, reflected light from the record medium is received by the light reception element and the type of record medium can be detected based on the light reception amount of the light reception element without coming in mechanical contact with the record medium; damage to the record medium, such as distortion, does not occur.

According to another aspect of the invention, the double-sided record apparatus further includes: a print delay unit configured to delay a start time until recording on a second side of the record medium after printing on a first side of the record medium.

According to this aspect, the double-sided record apparatus also includes the print delay unit for delaying the start time until recording on the back of the print medium after recording on the surface when the record medium is a medium of the type wherein the ink absorption speed is low, so that drying of ink ejected to the print medium can be speeded up and the quality of the images printed on the surface and the back of the record medium is not impaired.

According to another aspect of the invention, the double-sided record apparatus further includes: an air blowing unit that blows air on one side of the record medium; wherein print on the other side of the record medium is performed after print on the one side; and the air blowing unit blows air on the one side where print is complete before print on the other side is started.

According to this aspect, before record on the other side of the record medium is started, the air blowing unit blows air on the one side of the record medium where print is complete for speeding up drying of ink on the surface. Thus, to record on the other side of the record medium, the ink ejected to the one side is prevented from penetrating into the other side of the record medium and being mixed with the ink on the other side, and the quality of the images printed on both sides of the record medium can be improved.

According to another aspect of the invention, an image forming apparatus, includes: a print unit that ejects ink onto a face of a record medium to form an image thereon; a counting unit configured to count the number of ejected ink droplets to a predetermined area on the record medium, per color; a calculating unit configured to calculate the total number of ink droplets based on the counted results of the counting unit, while weighting the counted results respectively; a comparison unit configured to compare the number calculated by the calculating unit with a predetermined value; and a determination unit configured to determine whether double-sided print on the record medium is enabled based on a comparison result of the comparison unit.

According to another aspect of the invention, an image forming apparatus includes: a print unit that ejects ink onto a face of a record medium to form an image thereon; a counting unit configured to count the number of ejected ink droplets to a predetermined area on the record medium; a reference setting unit configured to set a reference value according to a type of image to be formed on the face of the recording medium; and a determination unit configured to determine whether double-sided print on the record medium is enabled based on a comparison result between the reference value and the number counted by of the counting unit.

According to another aspect of the invention, a print head for ejecting ink onto a face of a record medium is moved relatively to the record medium and images are formed on both sides of the record medium through the print head. A double-sided print method includes: counting the number of ejected ink droplets to a predetermined area on the record medium from the print head; comparing the counted number of ejected ink droplets with a predetermined value; and determining whether double-sided record of the record medium is enabled based on the comparison result.

According to this aspect, the number of ejected ink droplets to the surface of the record medium is counted for finding the amount of ink ejected to the surface of the record medium, and whether or not execution of print on the back of the record medium is enabled is determined based on the number of ejected ink droplets. Thus, when print on the back of the record medium is executed, the image quality is not impaired and high-quality images can be provided on both sides of the record medium.

According to another aspect of the invention, the determining step includes determining that double-sided record on the record medium is disabled when the counted number of ejected ink droplets exceeds the predetermined value.

According to this aspect, when the number of ejected ink droplets to the surface of the record medium is large, the ink printed on the surface of the record medium penetrates into the back of the record medium and if print is executed on the back of the record medium, the quality of the images printed on the surface and the back of the record medium is easily impaired. Thus, when the number of ejected ink droplets exceeds the predetermined value, record on the back of the record medium is disabled, whereby the image quality is not impaired.

According to another aspect of the invention, the method further includes: reversing the record medium to record on both sides thereof; wherein the reversing step is omitted when double-sided record on the record medium is determined to be disabled in the determining step.

According to this aspect, if record on the back of the record medium is not performed, the record medium is not reversed, so that the load for reversing the record medium is not imposed on the record medium or the double-sided record apparatus and smooth print operation is accomplished.

According to another aspect of the invention, the method further includes setting the predetermined value according to a type of image to be formed.

BRIEF DESCRIPTION OF THE DRAWINGS

The present invention may be more readily described with reference to the accompanying drawings, in which.

DETAILED DESCRIPTION OF THE PREFERRED EMBODIMENTS (First Embodiment)

Next, the configuration of an ink jet printer as one embodiment of a double-sided record apparatus of the invention will be discussed.

Figure 1:
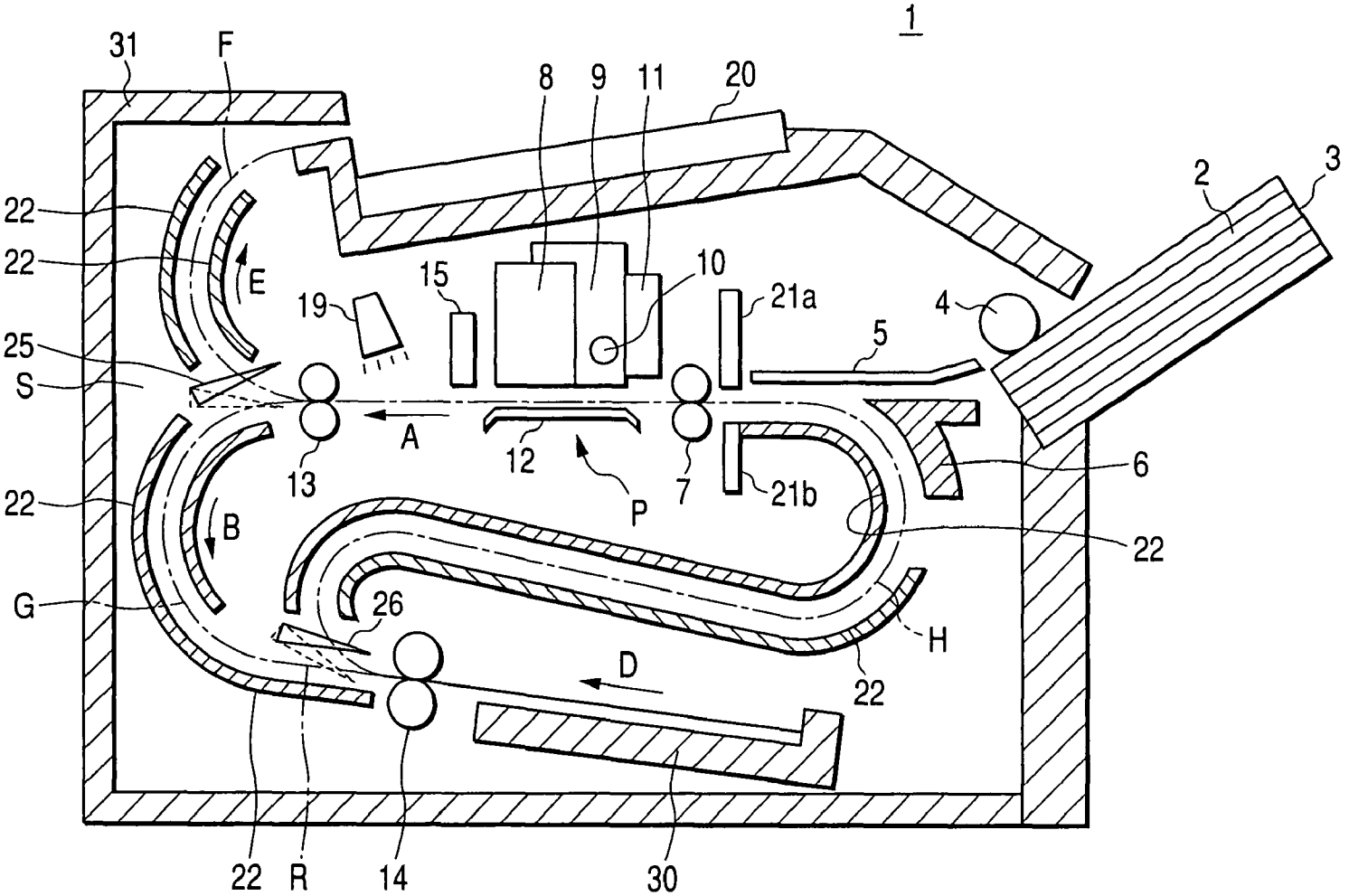
FIG. 1 is a sectional view to schematically represent the internal configuration of an ink jet printer in a first embodiment of the invention.
Figure 2:
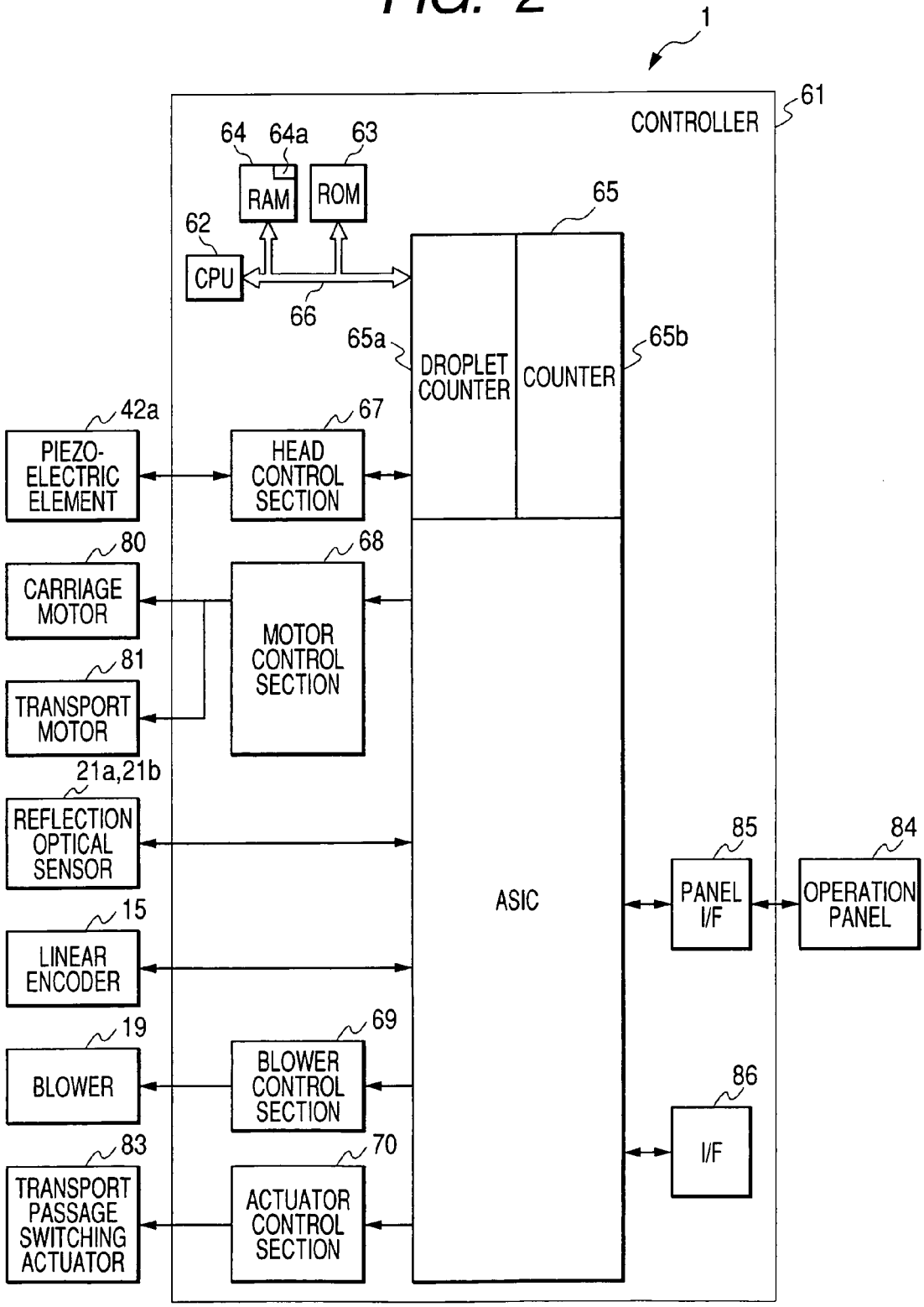
FIG. 2 is a block diagram to represent the configuration of a controller of the ink jet printer in the first embodiment of the invention.

FIG. 1 is a sectional view to schematically represent the internal configuration of an ink jet printer 1. FIG. 2 is a block diagram to represent the configuration of the ink jet printer 1.

In FIG. 1, the ink jet printer 1 includes a paper feed roller 4 placed in a cabinet 31 of the ink jet printer 1 and driven by a transport motor (not shown) for feeding record paper 2 provided as a record medium into the cabinet 31 of the ink jet printer 1.

To form an image on the record paper 2, first the record paper 2 stacked on a paper feed tray 3 is fed into the cabinet 31 of the ink jet printer 1 one sheet at a time starting at the top sheet by the paper feed roller 4, passes through the space between an upper guide 5 and a lower guide 6, and is sent to a transport passage (alternate long and short dashed line in the figure). Next, the record paper 2 is transported to a record position P along the transport passage by transport rollers 7.

At the record position P, a print head 8 for ejecting ink is supported on a carriage 9 to form an image on the record paper 2 transported by the transport rollers 7, and a platen 12 for supporting the record paper 2 from the back is provided at the position opposed to the print head 8.

The carriage 9 is guided along a guide shat 10 and a guide rail 11 and reciprocates in a direction (perpendicular direction to the plane of FIG. 1, called main scanning direction) orthogonal to a transport direction A (subscanning direction) of the record paper 2 in the figure parallel with the record paper 2 by the drive force of a carriage motor (not shown). The print head 8 is scanned in the main scanning direction by means of the carriage 9.

A linear encoder 15 for detecting the move distance of the print head 8 in the main scanning direction is provided so that it is opposed to the carriage 9 along the main scanning direction.

The print head 8 includes ink tanks (not shown) provided separately for four color inks (yellow, cyan, magenta, and black) and a plurality of minute nozzles (not shown) for ejecting ink in each ink tank to the record paper 2 based on a drive signal from a head control section (not shown).

Next, while the record paper 2 is transported at predetermined pitches in the subscanning direction and the print head 8 is moved in the main scanning direction at the record position P, ink is ejected through the print head 8 onto the face of the record paper 2 (first side) to form a predetermined image. That is, to form a continuous image on the record paper 2, the transport operation of the record paper 2 in the subscanning direction by rotating the transport rollers 7 and the image formation operation by means of the print head 8 (move in the main scanning direction and ink ejection operation) are repeated alternately.

Next, the record paper 2 with an image formed on the face is introduced into a transport passage switching section S by transport rollers 13.

The transport passage switching section S is provided with a flapper 25 that can be moved to the position indicated by the solid line or the dashed line by a transport passage switching actuator 83 (see FIG. 2). As the flapper 25 moves, the transport direction of the record paper 2 is switched to the arrow B or E direction.

Next, if double-sided record is selected, the flapper 25 is placed at the solid line position, so that the record paper 2 is transported in the arrow B direction along a transport passage G by the transport rollers 13, passes through a transport passage switching section R and transport rollers 14, and is transported to a paper re-feed section 30 provided in a lower part of the cabinet 31 of the ink jet printer 1. Like the transport passage switching section S, the transport passage switching section R is provided with a flapper 26 that can be moved to the position indicated by the solid line or the dashed line by the transport passage switching actuator 83. As the tip of the flapper 26 moves to the dashed line position, the transport direction of the record paper 2 is switched. When the record paper 2 is transported to the paper re-feed section 30, the flapper 26 is placed at the solid line position.

Next, the rotation direction of the transport rollers 14 is reversed and the record paper 2 is backward fed in a D direction in the figure and is transported to the transport passage switching section R. At this time, since the flapper 26 is placed at the dashed line position, the record paper 2 is reversed through a transport passage H shaped like a letter S and is again introduced into the record position P by the transport rollers 7 and ink is ejected through the print head 8 onto the face of the record paper 2 (in this case, second side) to form a predetermined image on the second side of the record paper 2. The function of the reversal unit in this embodiment is provided by the transport passage switching actuator 83, the transport passages G and H, the flappers 25 and 26, the transport rollers 14, and the paper re-feed section 30.

Next, the record paper 2 with the images formed on both sides (first and second sides) is again introduced into the transport passage switching section S by transport rollers 13. As the flapper 25 is placed the position indicated by the dashed line, the record paper 2 is transported upward along a transport passage F and is stacked on an ejection tray 20 in order. In this case, however, the record paper 2 is ejected onto the ejection tray 20 in a state in which the second side of the record paper 2 last printed by means of the print head 8 is downward, namely, the second side of the record paper 2 is placed with its face down. Thus, to form continuous text or image across both sides of two or more sheets of the record paper 2, the second page is preferably recorded on the first face. Alternatively, after the text or image is recorded on the second side, again the record paper 2 may be passed through the transport passages G and H for again reversing the record paper 2 before the record paper 2 is ejected onto the ejection tray 20.

The ink jet printer 1 of the embodiment includes two reflection optical sensors 21*a* and 21*b* each made up of a light emission element and a light reception element at a midpoint between the print head 8 and the paper feed roller 4. The reflection optical sensors 21*a* and 21*b* are used to determine the type of record paper 2; the reflection optical sensor 21*a* is placed above the transport passage and the reflection optical sensor 21*b* is placed at a position opposed to the reflection optical sensor 21*a* with the transport passage between. The reflection optical sensors 21*a* and 21*b* are made up of each a light emission element for emitting light to the surface of the record paper 2 and a light reception element for receiving reflected light from the surface of the record paper 2. When the record paper 2 is transported from the paper feed roller 4, a controller 61 determines the type of record paper 2 based on the amounts of reflected light received by the light reception elements of the two reflection optical sensors 21*a* and 21*b*. For example, if both the reflected light amounts on both sides are greater than a predetermined value, the controller 61 determines that the record paper 2 is paper dedicated to double-sided record with both sides being glossy surface, ink-dedicated surface, etc. If at least the amount of reflected light received by the light reception element of the reflection optical sensor 21*b* is less than the predetermined value, the controller 61 determines that the record paper 2 is not paper dedicated to double-sided record. However, if the controller 61 previously acquires the type of record paper 2 as the user previously enters the type of record paper 2 through an operation panel 84 or individual information of the record paper 2 is received through an interface 86 from a PC (personal computer), the controller 61 need not make an automatic determination of the type of record paper 2.

A blower 19 is provided behind the print head 8 (A direction in the figure) for making it possible to blow air on the record paper 2 with ink ejected thereto as required for speeding up drying the ink.

A plurality of guides 22 for guiding the record paper 2 along the transport passage (dashed line in the figure) are formed in the cabinet 31 of the ink jet printer 1.

Next, the configuration of the control system of the ink jet printer 1 according to the invention will be discussed with FIG. 2. FIG. 2 is a block diagram of the controller 61 for forming an image on the record paper 2 in the ink jet printer 1.

The controller 61 controls transporting the record paper 2 and controls print conditions of an image on the record paper 2 based on the data input/output through a panel interface 85 as the user operates the operation panel 84. The controller 61 is implemented as a microcomputer centering on a CPU 62, ROM 63, and RAM 64 connected to an ASIC (application-specific integrated circuit) 65. The controller 61 controls the whole operation of the ink jet printer 1 in addition to the above-mentioned control operation, needless to say.

In FIG. 2, the controller 61 includes the CPU 62 for processing image information and controlling the sections of the ink jet printer 1, the ROM 63 for storing programs, parameters, etc., required for the CPU 62 to perform control, the RAM 64 for storing image information and various pieces of data, and the ASIC 65, which are connected by a bus 66.

Figure 10:
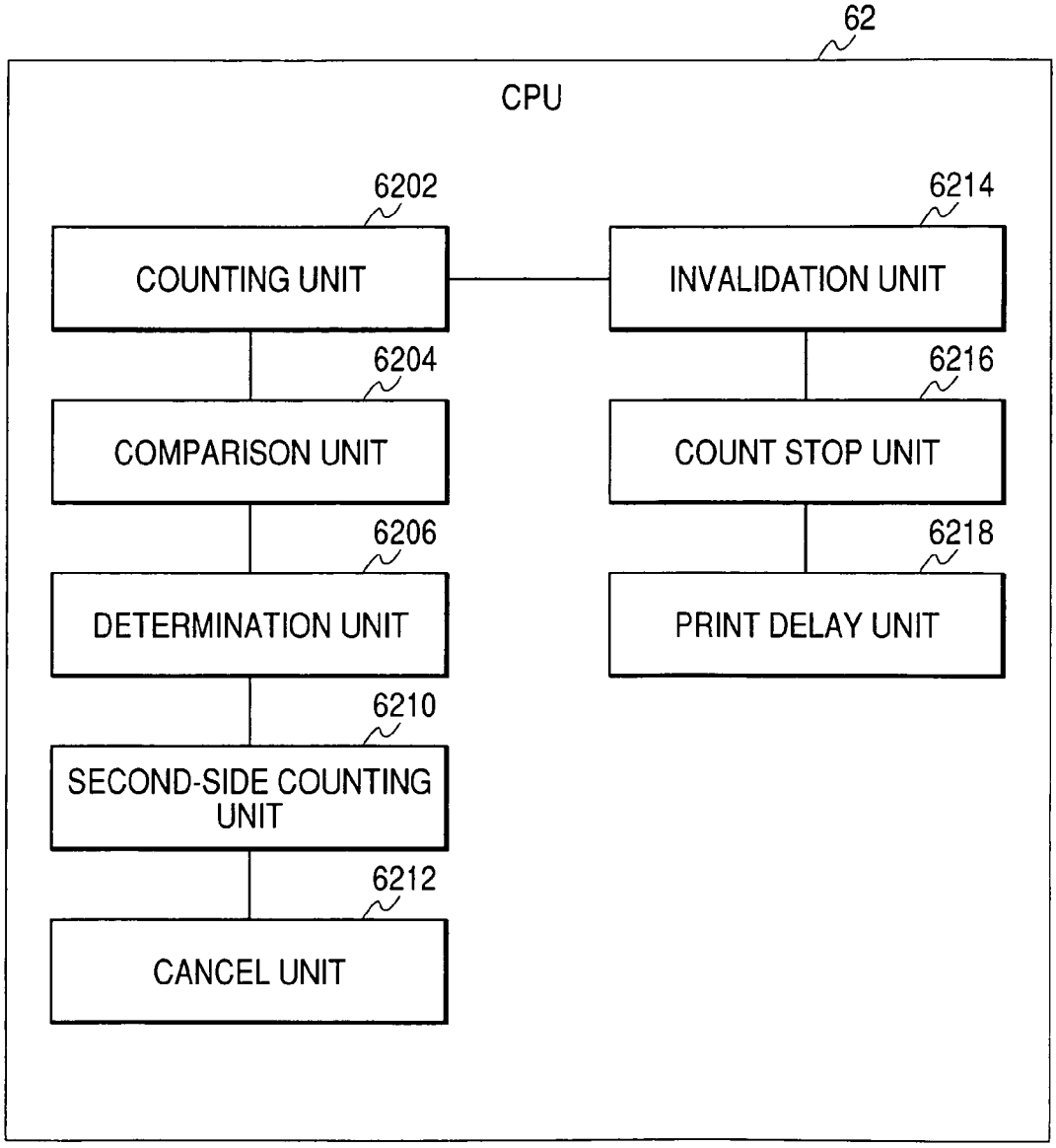
FIG. 10 is a block diagram schematically showing a configuration in the CPU shown in FIG. 2.

FIG. 10 shows a configuration of the CPU 62. As shown in FIG. 10, the CPU 62 includes a counting unit 6202, a comparison unit 6204, a determination unit 6206, a second-side counting unit 6210, a cancel unit 6212, an invalidation unit 6214, a count stop unit 6216, and a print delay unit 6218.

Connected to the ASIC 65 are a head control section 67 for driving piezoelectric-transducer crystal elements 42*a* of the print head 8 in response to a drive signal generated in response to image information, a motor control section 68 for driving various motors such as a carriage motor 80 and a transport motor 81, the reflection optical sensors 21*a* and 21*b* for detecting the type of record paper 2, the interface 86 (I/F) for inputting/outputting image information from/to an external personal computer, etc., the linear encoder 15 for outputting a pulse signal in accordance with a move of the print head 8 in the main scanning direction, an air blowing control section 69 for controlling the drive operation of the blower 19 for blowing air on the image formation face of the record paper 2, an actuator control section 70 for driving the transport passage switching actuator 83, and the like.

The function of a detection unit for detecting the type of record medium in this embodiment is provided by the reflection optical sensors 21*a* and 21*b*.

The function of an air blowing unit in this embodiment is provided by the blower 19 and the air blowing control section 69. In FIG. 1, the blower 19 is fixed, but may be provided with an oscillating mechanism (not shown) for drying the side of the record paper on which an image has been formed by means of the print head 8 over a wide range. The direction of oscillating may be a direction orthogonal to or parallel with the transport direction of the record paper 2. If the blower 19 has roughly the same width as the record paper 2, the blower 19 may oscillate only in the direction parallel with the transport direction of the record paper 2.

The ASIC 65, which is implemented as a known gate array, contains a drive signal generation circuit for generating a drive signal to drive the piezoelectric-transducer elements 42*a* for ejecting ink through nozzles of the print head 8 and a droplet counter 65*a* for counting the number of ink droplets ejected from the print head 8 based on the drive signal. The droplet counter 65*a* accepts a control signal for turning on/off its function at a predetermined timing based on a pulse signal from the linear encoder 15. The ASIC 65 also includes a counter 65*b* for analyzing print data transmitted through the interface 86 from an external PC (personal computer) (not shown) or an external image reader (not shown) and counting the number of ejected ink droplets before ink is ejected onto the record paper 2. The ASIC 65 further contains a counting on/off switch for selectively counting only the drive signals corresponding to predetermined nozzles of the print head 8; the counting on/off switch can be externally set (by the CPU 62).

The ASIC 65 also includes an image information conversion circuit for converting image information to be recorded on one side of the record paper 2, namely, image information stored for one page in a predetermined area in the RAM 64 into an appropriate listing responsive to the scanning direction in such a manner that the image information is read from the top or the last. More particularly, when the CPU 62 inputs information specifying the storage location (address), the amount (usually, constant amount), and the read direction of the image information stored so as to correspond to each scanning in the RAM 64 in response to scanning into the ASIC 65, the image information conversion circuit reads the image information in response to the specification information from the CPU 62 from a predetermined area in the RAM 64 by a DMA (direct memory access) function contained in the ASIC 65 and converts the image information and then outputs the provided image information to the drive signal generation circuit of the print head 8. The ASIC 65 controls the head control section 67, the motor control section 68, the reflection optical sensors 21*a* and 21*b*, the air blowing control section 69, the actuator control section 70, and the like in accordance with the processing executed by the CPU 62 based on operation information entered through the operation panel 84 and the panel interface 85, image information, the pulse signal input from the linear encoder 15, and the like.

Here, the image information refers to bit map data as on/off information of dots; print data in the bit map data format may be transmitted directly from an external personal computer, etc., through the interface 86 or print data described in a page description language, etc., may be received and be analyzed to create the image information as on/off information of dots by the CPU 62. In either case, the image information can be stored in a predetermined area in the RAM 64 in the format corresponding to scanning for each color by the CPU 62 and can be read selectively.

The operation panel 84 is provided with an operation key for specifying the area in which the number of ejected ink droplets is counted. That is, the user uses the operation panel 84 to specify the area in which the number of ejected ink droplets from the print head 8 is counted as each page, as each area where the print head 8 is operated once in the main scanning direction, as each area where the print head 8 is operated within a predetermined print time, or as each area in which the print head 8 moves a predetermined distance for switching the area in which the number of ejected ink droplets is counted. The function of an area specification unit in the embodiment is provided by the operation panel 84.

The operation panel 84 is also provided with an operation key for entering the type of record paper 2 such as paper dedicated to double-sided record or plain record paper. The function of a record medium type entry unit in the embodiment is provided by the operation panel 84.

The operation panel 84 is also provided with an operation key of the start time so that the start time until recording on the second side of the print paper 2 after printing on the first side can be delayed if the record paper 2 is record paper of the type wherein the ink absorption speed is low. The function of a print delay unit in the embodiment is provided by the operation panel 84.

Identification information indicating the type of record paper 2 can also be received through the interface 86 from an external personal computer, etc., as described above. The function of a reception unit in the embodiment is provided by the interface 86.

The signal indicating the type of record paper 2 entered through the operation panel 84 and the signal indicating the type of record paper 2 detected by the reflection optical sensors 21*a* and 21*b* are sent through the ASIC 65 to the CPU 62, which then controls the record operation based on the signals.

The function of a recognition unit for recognizing the type of record paper 2 in the embodiment is provided by the controller 61 centering on the CPU 62, the ROM 63, and the RAM 64.

The ROM 63 stores a program for determining whether or not double-sided record on the record paper 2 is enabled as well as a program for the CPU 62 to control the record operation on the record paper 2.

Next, the processing procedure of the record operation of the ink jet printer 1 will be discussed according to FIG. 3. "S" in the flowchart denotes step. In the following processing procedure, it is assumed that the user previously operates the operation panel 84 to specify counting the number of ejected ink droplets separately on each page of both sides of the record paper 2 as a predetermined area in which the number of ejected ink droplets is counted. Further, it is assumed that the user operates the operation panel 84 to preset double-sided record mode or single-sided record mode as the record mode and the type of record paper 2. In the processing procedure in FIG. 3, before print, the number of ejected ink droplets is counted for each page for two-page print data and whether or not double-sided record is enabled is determined for printing.

Figure 3:
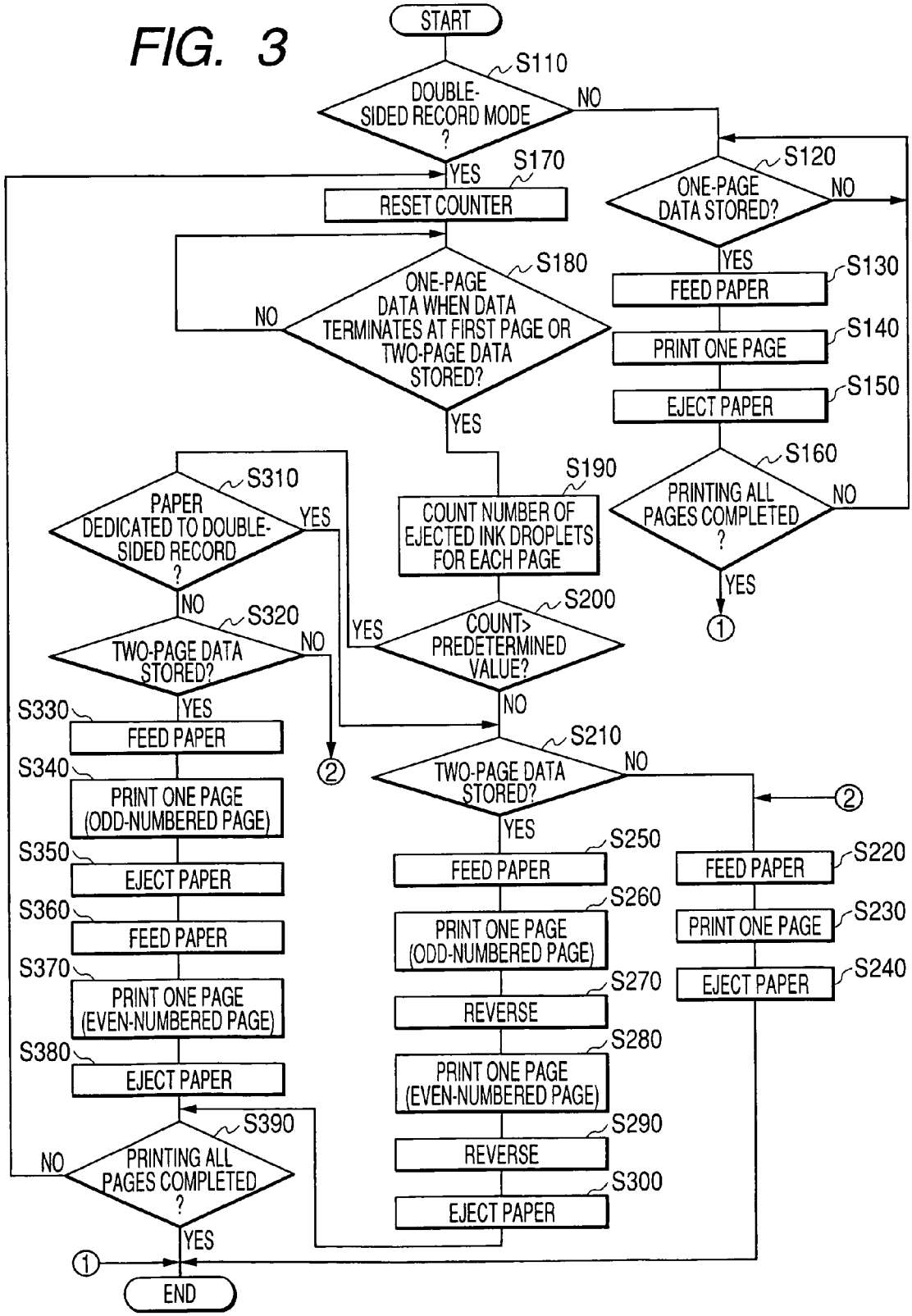
FIG. 3 is a flowchart to represent a processing procedure of record operation in the ink jet printer in the first embodiment of the invention.

As the processing procedure of the record operation on the record paper 2, the control procedure shown in the flowchart of FIG. 3 is started when the user gives a command for recording on the record paper 2 to the ink jet printer 1.

To begin with, at S110, the information stored in the RAM 64 is read and whether or not the record mode preset by the user is the double-sided record mode is determined.

Next, if the record mode is not the double-sided record mode (NO) at S110, print on the second side (back) of the record paper 2 is not required and thus the process proceeds to S120 at which image information is read from the RAM 64 and whether or not one-page image information, namely, the print data to be printed on the first side of the record paper 2 has been stored in the RAM 64 is determined. If one-page print data is stored (YES) at S120, the process proceeds to S130. On the other hand, if one-page print data is not stored (NO) at S120, a wait state is entered until one-page print data is stored in the RAM 64 through the interface (I/F) 86 from an external personal computer (not shown) or an external image reader (not shown). After one-page print data is stored in the RAM 64, the process proceeds to S130. Next, the paper feed roller 4 is driven for feeding one sheet of record paper 2 stacked on the paper feed tray 3 into the cabinet 31 of the ink jet printer 1. Next, at S140, while the head control section 67 and the motor control section 68 are controlled for transporting the record paper 2 at predetermined pitches in the sub-scanning direction and moving the print head 8 in the main scanning direction, ink is ejected onto the face of the record paper 2 through the print head 8 for printing one page. Next, at S150, the record paper 2 is ejected through the transport passage F to the ejection tray 20. Next, at S160, whether all pages have been printed is determined based on the image information in the RAM 64. If all pages have been printed (YES) at S160, the control procedure of the record operation of the CPU 62 terminates. If image formation on all pages is not completed (NO) at S160, the process returns to S120 and S120 to S160 are repeated. If the determination at S160 becomes YES, the control procedure of the record operation of the CPU 62 terminates.

Next, if the record mode is the double-sided record mode (YES) at S110, the process proceeds to S170 and the counter 65*b* in the ASIC 65 is reset. This means that the number of ejected ink droplets stored in the counter 65*b* (the previous counted number of ejected ink droplets) is initialized.

Next, at S180, when print data terminates at the first page, whether or not one-page print data is stored in the RAM 64 is determined or whether or not two-page print data is stored is determined. If one-page print data when print data terminates at the first page or two-page print data is not stored in the RAM 64 (NO) at S180, a wait state is entered until print data is stored in the RAM 64 through the interface (I/F) 86 from the external personal computer (not shown) or the external image reader (not shown). After print data is stored in the RAM 64, the process proceeds to S190.

Next, at S190, the print data (on/off information of dots) stored in the predetermined area in the RAM 64 is read and the number of ejected ink droplets required for printing on the face of the record paper 2 for each page is counted. S190 is executed by the counting unit 6202.

Next, at S200, the number of ejected ink droplets for each page counted at S190 is compared with a predetermined value to determine whether or not the number of ejected ink droplets exceeds the predetermined value. When print data terminates at the first page, the number of ejected ink droplets for the one page is compared with the predetermined value, needless to say. S200 is executed by the comparison unit 6204.

Next, if the number of ejected ink droplets for each page or the one page does not exceed the predetermined value (NO) at S200, the process proceeds to S210; if the number of ejected ink droplets at least for one page exceeds the predetermined value (YES) at S200, the process proceeds to S310. That is, to form an image on the second side (back) of the record paper 2, if it is determined at S200 that the number of ejected ink droplets does not exceed the predetermined value to determine whether or not double-sided record is enabled, it is determined that double-sided record is enabled, and the process proceeds to S210. On the other hand, if the number of ejected ink droplets exceeds the predetermined value, it is determined that double-sided record is disabled, and the process proceeds to S310. The determination unit 6206 executes S200. At the time, if two-page print data is stored and the number of ejected ink droplets for each of the two pages is equal to or less than the predetermined value (NO), the process proceeds to S210; if the number of ejected ink droplets at least for either page exceeds the predetermined value (YES), the process proceeds to S310. When the print data terminates at the first page, if the number of ejected ink droplets for the one page exceeds the predetermined value (YES), the process proceeds to S310; if the number of ejected ink droplets for the one page does not exceed the predetermined value (NO), the process proceeds to S210. However, when the print data terminates at the first page, printing is not executed on the back and thus the flowchart may be changed so that the process proceeds to S130 or S220 immediately when it is determined at S180 that the print data terminates at the first page.

Next, at S210, the image information is read from the RAM 64 and whether two-page image information, namely, two-page print data is stored or print data terminates at the first page is determined. If it is determined at S210 that print data terminates at the first page (NO), the process proceeds to S220 and one sheet of record paper 2 stacked on the paper feed tray 3 is fed into the cabinet 31 of the ink jet printer 1.

Next, at S230, while the head control section 67 and the motor control section 68 are controlled for transporting the record paper 2 at the predetermined pitches in the subscanning direction and moving the print head 8 in the main scanning direction, ink is ejected onto the face of the record paper 2 through the print head 8 for printing one page on the first side of the record paper 2. Next, at S240, the record paper 2 is ejected through the transport passage F to the ejection tray 20 and then the control procedure of the record operation of the CPU 62 terminates. At S210 to S240, two-page print data is not stored and the one-page print data is the last page and therefore the record paper 2 is ejected and then the control procedure terminates.

On the other hand, if it is determined at S210 that two-page print data is stored (YES), the process proceeds to S250 and one sheet of record paper 2 stacked on the paper feed tray 3 is fed into the cabinet 31 of the ink jet printer 1. Next, at S260, while the head control section 67 and the motor control section 68 are controlled for transporting the record paper 2 at the predetermined pitches in the subscanning direction and moving the print head 8 in the main scanning direction, ink is ejected onto the face of the record paper 2 through the print head 8 for printing one page of an odd-numbered page (first side) on the face of the record paper 2. Next, at S270, the record paper 2 is reversed through the transport passages G and H in the cabinet 31 of the ink jet printer 1 and again is transported to the record position P. Next, at S280, ink is ejected onto the face of the record paper 2 through the print head 8 for printing one page of an even-numbered page (second side). Next, at S290, the record paper 2 is reversed through the transport passages G and H in the cabinet 31 of the ink jet printer 1 and subsequently at S300, the record paper 2 is passed through the transport passage F in the cabinet 31 of the ink jet printer 1 and is ejected to the ejection tray 20 so that the odd-numbered page is face down. Next, at S390, whether all pages have been printed is determined. If all pages have been printed (YES) at S390, the control procedure of the record operation of the CPU 62 terminates. If it is not determined at S390 that all pages have been printed (NO), the process returns to S170.

On the other hand, if it is determined at S200 that the number of ejected ink droplets at least for either page exceeds the predetermined value (YES), the process proceeds to S310.

Next, at S310, whether or not the record paper 2 is paper dedicated to double-sided record is determined. Since the user presets the type of record paper 2 or information concerning the type of record paper 2 is previously obtained from the PC, etc., through the interface 86 as described above, the information stored in the RAM 64 can be referenced for determining the type of record paper 2. If the record paper 2 is paper dedicated to double-sided record (YES) at S310, the process proceeds to S210 and S210 to S300 are executed. That is, if it is determined at S310 that the record paper 2 is paper dedicated to double-sided record, the result of determining that print on both sides is disabled at S200 is invalidated, and the procedure of printing on both sides of the record paper 2 is executed. The invalidation unit 6214 executes S310.

If the record paper 2 is not paper dedicated to double-sided record (NO) at S310, the process proceeds to S320. At S320, whether or not two-page print data is stored is determined. If it is determined at S320 that two-page print data is not stored (NO), namely, print data terminates at the first page, the process proceeds to S220 and S220 to S240 are executed and then the control procedure of the record operation of the CPU 62 terminates.

On the other hand, if it is determined at S320 that two-page print data is stored (YES), the process proceeds to S330 and one sheet of record paper 2 stacked on the paper feed tray 3 is fed into the cabinet 31 of the ink jet printer 1. Next, at S340, while the head control section 67 and the motor control section 68 are controlled for transporting the record paper 2 at the predetermined pitches in the subscanning direction and moving the print head 8 in the main scanning direction, ink is ejected onto the face of the record paper 2 through the print head 8 for printing one page of an odd-numbered page on the face of the record paper 2. Next, at S350, the record paper 2 is passed through the transport passage F in the cabinet 31 of the ink jet printer 1 and is ejected to the ejection tray 20. Next, at S360, one sheet of record paper 2 stacked on the paper feed tray 3 is fed into the cabinet 31 of the ink jet printer 1. Next, at S370, ink is ejected onto the face of the record paper 2 for printing one page of an even-numbered page on the face of the record paper 2 as similar operation to that at S340 is performed. Next, at S380, the record paper 2 is passed through the transport passage F in the cabinet 31 of the ink jet printer 1 and is ejected to the ejection tray 20.

Next, at S390, whether all pages have been printed is determined. If all pages have been printed (YES) at S390, the control procedure of the record operation of the CPU 62 terminates. On the other hand, if it is not determined at S390 that all pages have been printed (NO), the process returns to S170.

According to the first embodiment of the invention, at step S190, the number of ejected ink droplets for each page of the record paper 2 is previously counted before the print head 8 ejects ink to the record paper 2 and at S200, the counted number of ejected ink droplets is compared with the predetermined value to determine whether or not double-sided record is enabled, as shown in FIG. 3. Thus, when ink is ejected to both sides of the record paper 2 to form images, high-quality images can be provided without impairing the image quality. The presence or absence of back reflection can be precisely determined for various images and whether or not double-sided record is enabled can be effectively determined.

Whether or not the record paper 2 is paper dedicated to double-sided record is determined at S310. If the record paper 2 is paper dedicated to double-sided record, the result of determining that "print on both sides is disabled" at S200 is invalidated, and print on both sides is enabled. Thus, high-quality images can be efficiently formed on both sides of the record paper 2 conforming to the type of record paper 2.

One page of the record paper 2 is specified as the predetermined area in which the number of ejected ink droplets is counted. Thus, to form images continuously on two or more sheets of record paper 2, high-quality images can be provided with uniform image quality.

(Second Embodiment)

Figure 4:
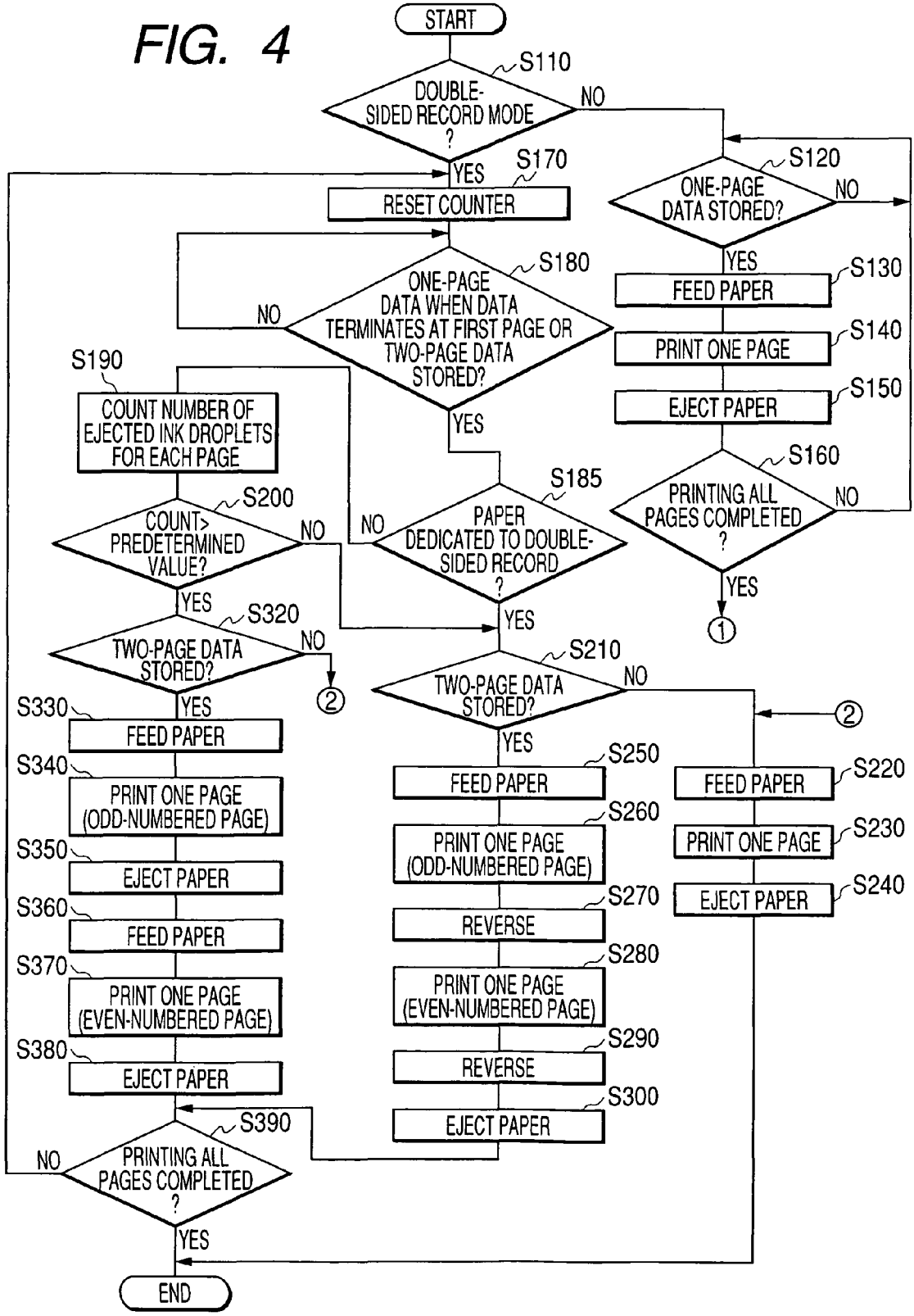
FIG. 4 is a flowchart to represent a processing procedure of record operation in a second embodiment of the invention.

Next, the processing procedure of record operation in a second embodiment of the invention will be discussed with a flowchart of FIG. 4. In the following processing procedure, it is assumed that the user previously operates an operation panel 84 to specify counting the number of ejected ink droplets separately on each page of both sides of record paper 2 as a predetermined area in which the number of ejected ink droplets is counted. Further, it is assumed that the user operates the operation panel 84 to preset double-sided record mode or single-sided record mode as the record mode and the type of record paper 2. The main steps in the second embodiment are similar to those in the first embodiment previously described with reference to the flowchart of FIG. 3 and therefore the common part will not be discussed again in detail and the characteristic part will be discussed below:

As the processing procedure of the record operation on the record paper 2, the control procedure shown in the flowchart of FIG. 4 is started when the user gives a command for recording on the record paper 2 to an ink jet printer 1.

To begin with, at S110, whether or not the record mode preset by the user is the double-sided record mode is determined.

Next, if the record mode is not the double-sided record mode (NO) at S110, print on the second side (back) of the record paper 2 is not required and thus the process proceeds to S120 and S120 to S160 are executed and when the determination at S160 becomes YES, the control procedure of the record operation of a CPU 62 terminates as in the first embodiment.

Next, if the record mode is the double-sided record mode (YES) at S110, the process proceeds to S170 and a counter 65*b* in an ASIC 65 is reset. Next, at S180, when print data terminates at the first page, whether or not one-page print data is stored in RAM 64 is determined or whether or not two-page print data is stored is determined. If one-page print data when print data terminates at the first page or two-page print data is not stored in the RAM 64 (NO) at S180, a wait state is entered until print data is input to the RAM 64 through an interface (I/F) 86 from an external personal computer (not shown) or an external image reader (not shown). After print data is stored in the RAM 64, the process proceeds to S185.

Next, at S185, whether or not the record paper 2 is paper dedicated to double-sided record is determined. In the embodiment unlike the first embodiment, the type of record paper 2 is determined immediately following S180. If the record paper 2 is paper dedicated to double-sided record (YES), the process proceeds to S210 and steps S210 to S300 are executed as in the first embodiment. That is, to print on both sides of the record paper 2, if it is determined at S185 that the record paper 2 is paper dedicated to double-sided record, it is determined that print on both sides is enabled without counting the number of ejected ink droplets, and the process proceeds to S210. The count stop unit 6216 executes S185.

On the other hand, if the record paper 2 is not paper dedicated to double-sided record (NO) at S185, the process proceeds to S190 and the print data (on/off information of dots) stored in a predetermined area in the RAM 64 is read and the number of ejected ink droplets required for printing on the face of the record paper 2 for each page is counted. If print data terminates at the first page, the number of ejected ink droplets for the one page is counted. Next, at S200, the number of ejected ink droplets counted at S190 is compared with a predetermined value to determine whether or not the number of ejected ink droplets exceeds the predetermined value.

Next, if the number of ejected ink droplets for each page or the one page does not exceed the predetermined value (NO) at S200, the process proceeds to S210 and S210 to S300 are executed as in the first embodiment.

On the other hand, if the number of ejected ink droplets at least for one page exceeds the predetermined value (YES) at S200, the process proceeds to S320 and S320 to S390 are executed as in the first embodiment.

According to the second embodiment of the invention, as shown in FIG. 4, after S180, whether or not the record paper 2 is paper dedicated to double-sided record is determined at S185. If the record paper 2 is paper dedicated to double-sided record, it is assumed that double-sided record can be executed regardless of the number of ejected ink droplets, and the process proceeds to S210. Double-sided record is enabled without counting the number of ejected ink droplets to the record paper 2. Thus, high-quality images can be provided on both sides of the record paper 2 conforming to the type of record paper 2, and the labor and time required for counting the number of ejected ink droplets can be decreased.

If the record paper 2 is not paper dedicated to double-sided record, at S190, the number of ejected ink droplets for each page of the record paper 2 is counted and the counted number of ejected ink droplets is compared with the predetermined value to determine whether or not double-sided record is enabled. Thus, when ink is ejected to both sides of the record paper 2 to form images, high-quality images can be provided without impairing the image quality.

(Third Embodiment)

Figure 5:
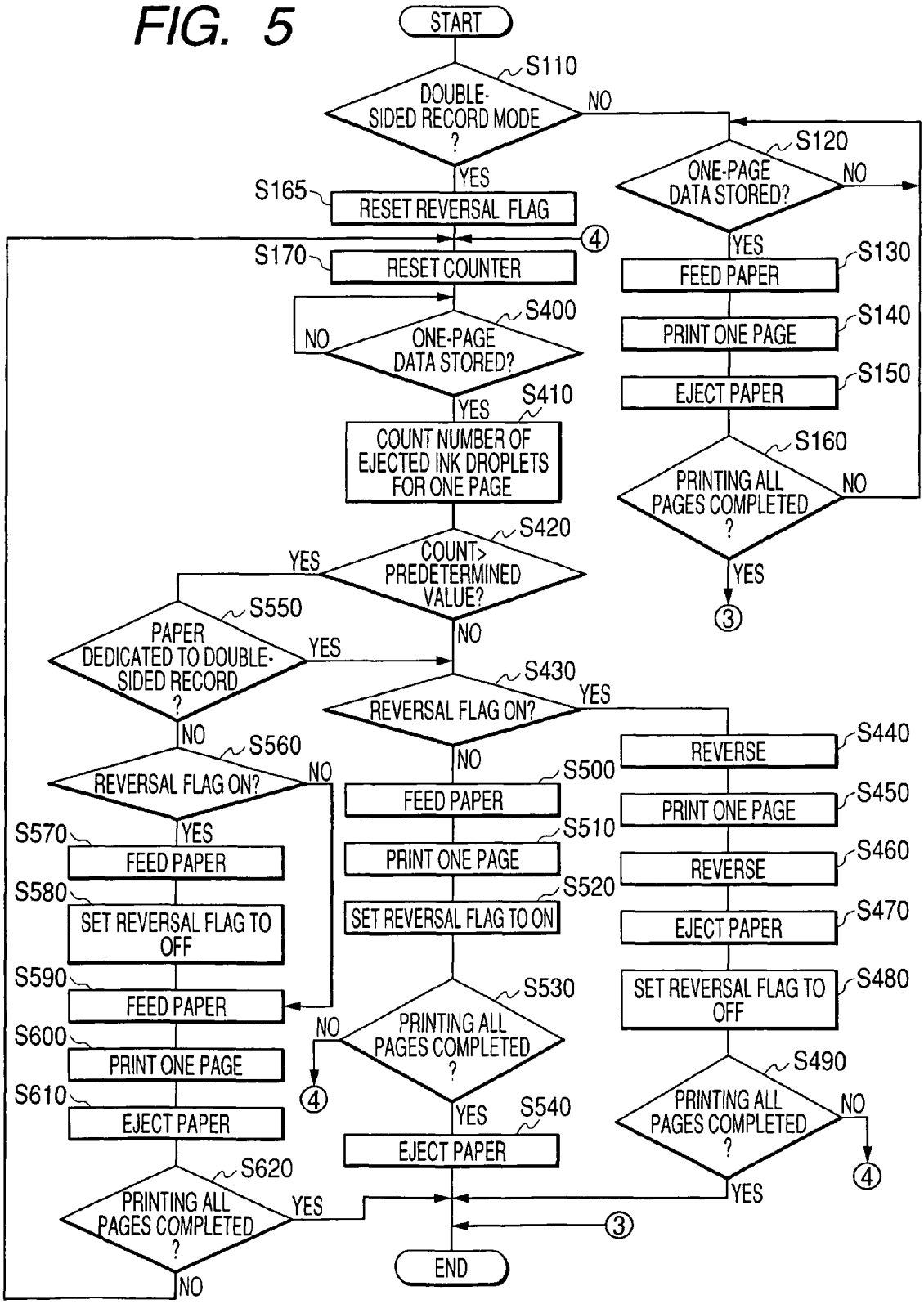
FIG. 5 is a flowchart to represent a processing procedure of record operation in a third embodiment of the invention.

Next, the processing procedure of record operation in a third embodiment of the invention will be discussed with a flowchart of FIG. 5. In the following processing procedure, it is assumed that the user previously operates an operation panel 84 to specify counting the number of ejected ink droplets separately on each page of both sides of record paper 2 as a predetermined area in which the number of ejected ink droplets is counted. Further, it is assumed that the user operates the operation panel 84 to preset double-sided record mode or single-sided record mode as the record mode and the type of record paper 2. In the first embodiment previously described with reference to FIG. 3, if the double-sided record mode is set, when two-page print data is stored, before print on the print paper 2, the number of ejected ink droplets is counted for each page for two-page print data and whether or not double-sided record is enabled is determined for printing. In, the third embodiment, however, before print on print paper 2, the number of ejected ink droplets is counted only for one-page print data and whether or not double-sided record is enabled is determined for printing. The main steps in the third embodiment are similar to those in the first embodiment previously described with reference to the flowchart of FIG. 3 and therefore the common part will not be discussed again in detail and the characteristic part will be discussed below:

As the processing procedure of the record operation on the record paper 2, the control procedure shown in the flowchart of FIG. 5 is started when the user gives a command for recording on the record paper 2 to an ink jet printer 1.

To begin with, at S110, whether or not the record mode preset by the user is the double-sided record mode is determined.

If it is determined that the record mode is not the double-sided record mode (NO), print on the second side (back) of the record paper 2 is not required and thus the process proceeds to S120 and S120 and the later steps are executed as in the first embodiment.

On the other hand, if it is determined at S110 that the record mode is the double-sided record mode (YES), the process proceeds to S165 and a reversal flag stored in a storage area 64*a* of RAM 64 is reset. This means that the reversal flag referenced when the record paper 2 is reversed is set to OFF. Next, at S170, a counter 65*b* in an ASIC 65 is reset.

Next, at S400, image information is read from the RAM 64 and whether or not one-page image information, namely, one-page print data has been stored in the RAM 64 is determined. If one-page print data is stored (YES) at S400, the process proceeds to S410; if one-page print data is not stored (NO) at S400, a wait state is entered until one-page print data is input to the RAM 64 through an interface (I/F) 86 from an external personal computer (not shown) or an external image reader (not shown). After one-page print data is stored in the RAM 64, the process proceeds to S410.

Next, at S410, one-page print data (on/off information of dots) stored in a predetermined area in the RAM 64 is read and the number of ejected ink droplets required for printing on the face of the record paper 2 is counted by the counter 65*b*. The counting unit 6202 executes S410.

Next, at S420, the number of ejected ink droplets counted at S410 is compared with a predetermined value to determine whether or not the number of ejected ink droplets exceeds the predetermined value. The comparison unit 6204 executes S420.

Next, if the number of ejected ink droplets does not exceed the predetermined value (NO) at S420, the process proceeds to S430; if the number of ejected ink droplets exceeds the predetermined value (YES), the process proceeds to S550. That is, if it is determined at S420 that the number of ejected ink droplets exceeds the predetermined value to determine whether or not double-sided record is enabled, it is determined that double-sided record is disabled, and the process proceeds to S550. On the other hand, if it is determined at S420 that the number of ejected ink droplets does not exceed the predetermined value, it is determined that double-sided record is enabled, and the process proceeds to S430. The determination unit 6206 executes S420.

If the number of ejected ink droplets does not exceed the predetermined value (NO) at S420, the process proceeds to S430 and the reversal flag storage area 64*a* in the RAM 64 is referenced for determining whether or not the reversal flag is ON. In the embodiment, in printing the first page (first side of the record paper 2), the reversal flag is reset at S165 and is set to OFF. That is, to print on the first side of the record paper 2, the reversal flag is OFF; to print on the second side of the record paper 2, the reversal flag is ON.

Next, if the reversal flag is ON (YES) at S430, it means that print on the first side of the record paper 2 is already complete. Then, to print on the second side of the record paper 2, the process proceeds to S440 and the record paper 2 is reversed through transport passages G and H in a cabinet 31 of the ink jet printer 1 and again is transported to a record position P. Next, at S450, ink is ejected onto the face of the record paper 2 through a print head 8 for printing one page on the second side of the record paper 2. Next, at S460, the record paper 2 is again reversed through the transport passages G and H in the cabinet 31 of the ink jet printer 1 and subsequently at S470, the record paper 2 is passed through a transport passage F in the cabinet 31 of the ink jet printer 1 and is ejected to an ejection tray 20 so that the first side of the record paper 2 is placed with its facedown. Next, at S480, the reversal flag is set to OFF. Next, at S490, whether all pages have been printed is determined. If all pages have been printed (YES) at S490, the control procedure of the record operation of the CPU 62 terminates. If it is not determined at S490 that all pages have been printed (NO), the process returns to S170.

If it is not determined at S430 that the reversal flag is ON (NO), it means that print on the first side of the record paper 2 is not yet executed. Then, to print on the first side of the record paper 2, the process proceeds to S500 and one sheet of record paper 2 stacked on a paper feed tray 3 is fed into the cabinet 31 of the ink jet printer 1 and is transported to the record position P. Next, at S510, while a head control section 67 and a motor control section 68 are controlled for transporting the record paper 2 in the subscanning direction and moving the print head 8 in the main scanning direction, ink is ejected onto the face of the record paper 2 for printing one page on the first side of the record paper 2. Subsequently, at S520, the reversal flag signal is set to ON.

Next, at S530, whether all pages have been printed is determined. If it is determined at S530 that all pages have been printed (YES), the process proceeds to S540 and the record paper 2 is ejected through the transport passage F to the ejection tray 20 and then the control procedure of the record operation terminates. If it is not determined at S530 that all pages have been printed (NO), there is a possibility that print on the second side of the record paper 2 may be executed and thus the process returns to S170.

On the other hand, if it is determined at S420 that the number of ejected ink droplets exceeds the predetermined value (YES), it is determined that print on both sides of the record paper 2 is disabled, and the process proceeds to S550.

Next, at S550, whether or not the record paper 2 is paper dedicated to double-sided record is determined. If it is determined at S550 that the record paper 2 is paper dedicated to double-sided record (YES), the process proceeds to S430 and S430 and the later steps are executed. That is, if it is determined at S550 that the record paper 2 is paper dedicated to double-sided record, the result of determining that print on both sides is disabled at S420 is invalidated, and the procedure of printing on both sides of the record paper 2 is executed. The invalidation unit 6214 executes S550.

On the other hand, if it is not determined at S550 that the record paper 2 is paper dedicated to double-sided record (NO), the process proceeds to S560 and the reversal flag storage area 64*a* in the RAM 64 is referenced for determining whether or not the reversal flag is ON. If the reversal flag is ON (YES) at S560, the record paper 2 is passed through the transport passage F in the cabinet 31 of the ink jet printer 1 and is ejected to an ejection tray 20. That is, it is determined at S420 that double-sided record is disabled and the record paper 2 is not paper dedicated to double-sided record and thus the record paper 2 is ejected without printing on the second side of the record paper 2. Next, at S580, the reversal flag is set to OFF. Next, at S590, one sheet of record paper 2 stacked on the paper feed tray 3 is fed into the cabinet 31 of the ink jet printer 1 and is transported to the record position P. Next, at S600, while the head control section 67 and the motor control section 68 are controlled for transporting the record paper 2 in the subscanning direction and moving the print head 8 in the main scanning direction, ink is ejected onto the first side of the record paper 2 for printing one page. Next, at S610, the record paper 2 is passed through the transport passage F in the cabinet 31 of the ink jet printer 1 and is ejected to the ejection tray 20. Next, at S620, whether all pages have been printed is determined. If it is determined at S620 that all pages have been printed (YES), the control procedure of the record operation terminates. If it is not determined at S620 that all pages have been printed (NO), the process returns to S170. On the other hand, it is not determined at S560 that the reversal flag is ON (NO), to print on the first side of the record paper 2, the process proceeds to S590 and S590 and the later steps are executed.

According to the third embodiment of the invention, as shown in FIG. 5, before print on the print paper 2, the number of ejected ink droplets for one page of the record paper 2 is counted at S410 and the counted number of ejected ink droplets is compared with the predetermined value to determine whether or not double-sided record is enabled is determined. Thus, when ink is ejected to both sides of the record paper 2 to form images, high-quality images can be provided without impairing the image quality.

Whether or not the record paper is paper dedicated to double-sided record is determined at S550. If the record paper 2 is paper dedicated to double-sided record, the result of determining that "print on both sides is disabled" at S420 is invalidated, and print on both sides is enabled. Thus, high-quality images can be efficiently formed on both sides of the record paper 2 in response to the type of record paper 2.

(Fourth Embodiment)

Figure 6:
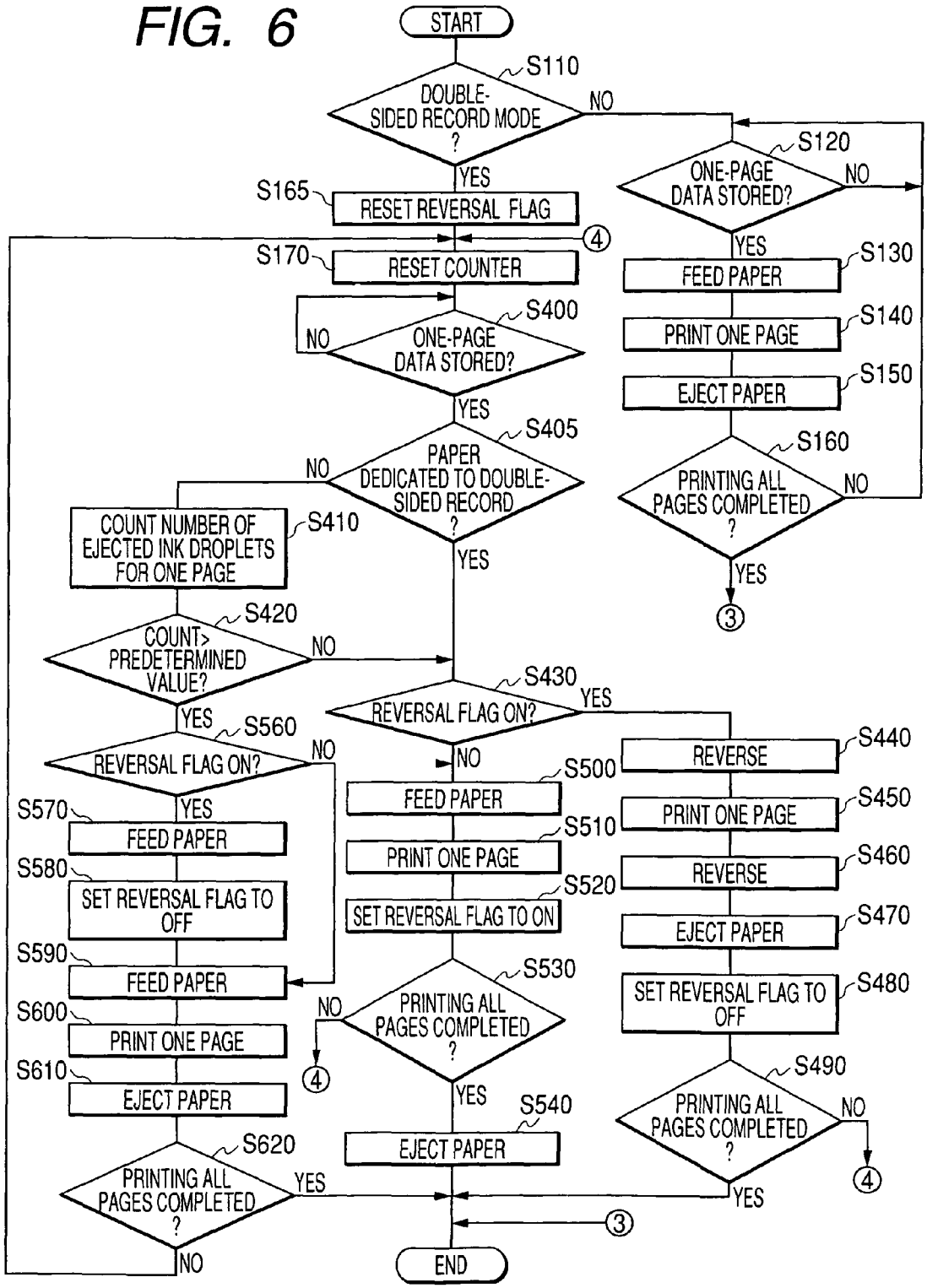
FIG. 6 is a flowchart to represent a processing procedure of record operation in a fourth embodiment of the invention.

Next, the processing procedure of record operation in a fourth embodiment of the invention will be discussed with a flowchart of FIG. 6. In the following processing procedure, it is assumed that the user previously operates an operation panel 84 to specify counting the number of ejected ink droplets separately on each page of both sides of record paper 2 as a predetermined area in which the number of ejected ink droplets is counted. Further, it is assumed that the user operates the operation panel 84 to preset double-sided record mode or single-sided record mode as the record mode and the type of record paper 2. The main steps in the fourth embodiment are similar to those in the third embodiment previously described with reference to the flowchart of FIG. 5 and therefore the common part will not be discussed again in detail and the characteristic part will be discussed below:

As the processing procedure of the record operation on the record paper 2, the control procedure shown in the flowchart of FIG. 6 is started when the user gives a command for recording on the record paper 2 to an ink jet printer 1.

To begin with, at S110, whether or not the record mode preset by the user is the double-sided record mode is determined.

If it is determined that the record mode is not the double-sided record mode (NO), print on the second side (back) of the record paper 2 is not required and thus the process proceeds to S120 and S120 and the later steps are executed as in the third embodiment.

On the other hand, if it is determined at S110 that the record mode is the double-sided record mode (YES), the process proceeds to S165 and a reversal flag is reset. Subsequently, at S170, a counter 65*b* in an ASIC 65 is reset.

Next, at S400, image information is read from the RAM 64 and whether or not one-page image information, namely, one-page print data has been stored in RAM 64 is determined. If one-page print data is stored (YES) at S400, the process proceeds to S405; if one-page print data is not stored (NO) at S400, a wait state is entered until one-page print data is input to the RAM 64 through an interface (I/F) 86 from an external personal computer (not shown) or an external image reader (not shown). After one-page print data is stored in the RAM 64, the process proceeds to S405.

Next, at S405, whether or not the record paper 2 is paper dedicated to double-sided record is determined. In the embodiment unlike the third embodiment, the type of record paper 2 is determined immediately following S400. If the record paper 2 is paper dedicated to double-sided record (YES), the process proceeds to S430 and S430 and the later steps are executed as in the third embodiment.

On the other hand, if the record paper 2 is not paper dedicated to double-sided record (NO), the process goes to S410 and the one-page print data (on/off information of dots) stored in a predetermined area in the RAM 64 is read and the number of ejected ink droplets required for printing on the face of the record paper 2 is counted by the counter 65*b*. Next, at S420, the number of ejected ink droplets counted at S410 is compared with a predetermined value to determine whether or not the number of ejected ink droplets exceeds the predetermined value.

If the number of ejected ink droplets does not exceed the predetermined value (NO), the process proceeds to S430 and S430 and the later steps are executed as in the third embodiment.

On the other hand, if the number of ejected ink droplets exceeds the predetermined value (YES) at S420, the process proceeds to S560 and S560 and the later steps are executed as in the third embodiment.

According to the fourth embodiment of the invention, as shown in FIG. 6, whether or not the record paper 2 is paper dedicated to double-sided record is determined at S405. If the record paper 2 is paper dedicated to double-sided record, it is assumed that double-sided record can be executed regardless of the number of ejected ink droplets, and the process proceeds to S430. Double-sided record is enabled without counting the number of ejected ink droplets to the record paper 2. Thus, high-quality images can be provided on both sides of the record paper 2 conforming to the type of record paper 2, and the load for counting the number of ejected ink droplets can be decreased.

If the record paper 2 is not paper dedicated to double-sided record, at S420, the number of ejected ink droplets for one page of the record paper 2 is counted and the counted number of ejected ink droplets is compared with the predetermined value to determine whether or not double-sided record is enabled. Thus, when ink is ejected to both sides of the record paper 2 to form images, high-quality images can be provided without impairing the image quality.

(Fifth Embodiment)

Figure 7:
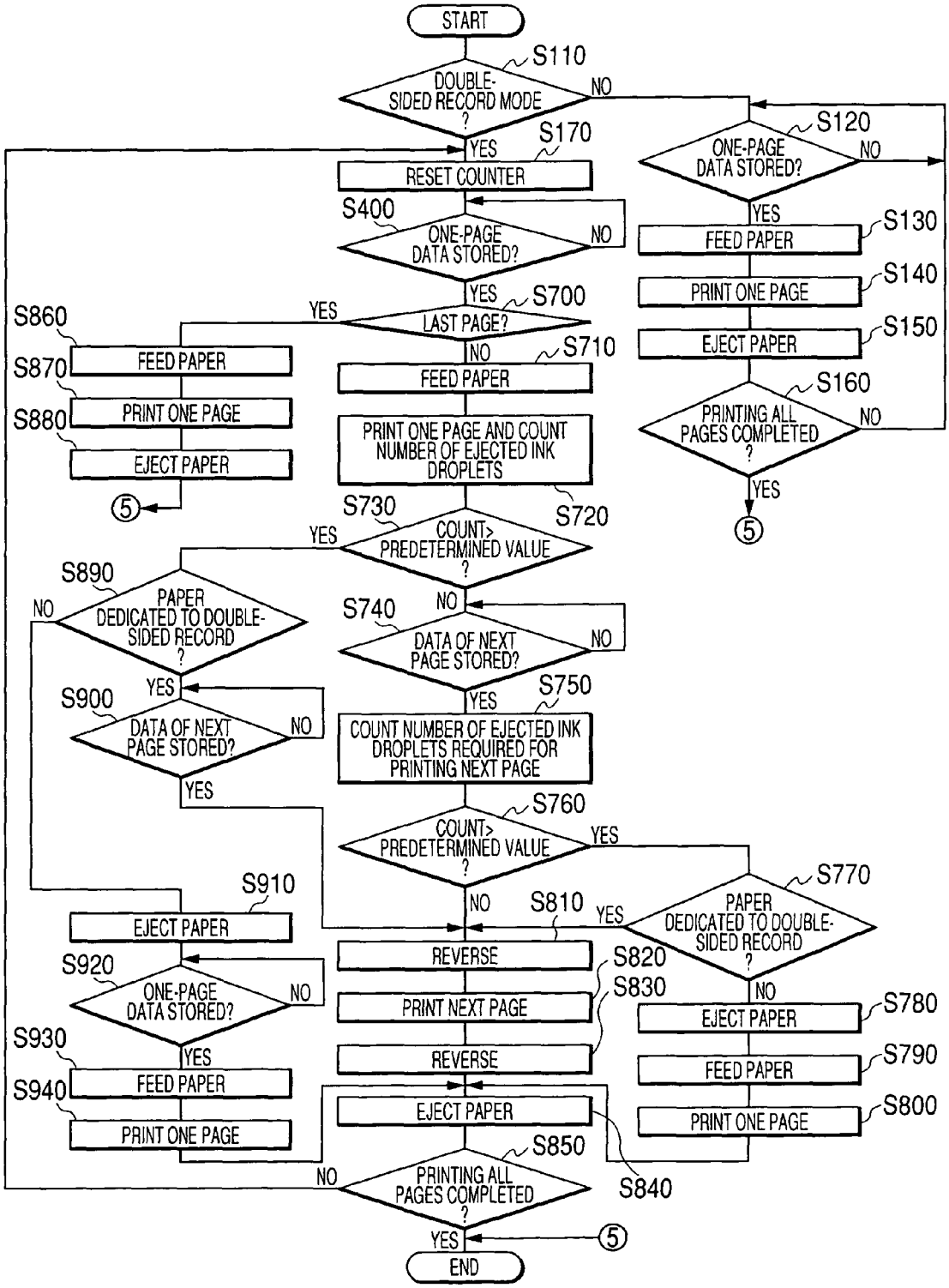
FIG. 7 is a flowchart to represent a processing procedure of record operation in a fifth embodiment of the invention.

Next, the processing procedure of record operation in a fifth embodiment of the invention will be discussed with a flowchart of FIG. 7. In the following processing procedure, it is assumed that the user previously operates an operation panel 84 to specify counting the number of ejected ink droplets separately on each page of both sides of record paper 2 as a predetermined area in which the number of ejected ink droplets is counted. Further, it is assumed that the user operates the operation panel 84 to preset double-sided record mode or single-sided record mode as the record mode and the type of record paper 2. In the processing procedure in FIG. 7 in the fifth embodiment, while or after print on the first side of record paper is executed, the number of ink droplets ejected onto the first side is counted and whether or not print on the second side is enabled, namely, double-sided record is enabled is determined for printing. Further, before print on the second side is executed, the number of ink droplets to be ejected onto the second side is previously counted and whether or not print on the second side is enabled, namely, double-sided record is enabled is determined for printing. The main steps in the fifth embodiment are similar to those in the first embodiment previously described with reference to the flowchart of FIG. 3 and therefore the common part will not be discussed again in detail and the characteristic part will be discussed below:

As the processing procedure of the record operation on the record paper 2, the control procedure shown in the flowchart of FIG. 7 is started when the user gives a command for recording on the record paper 2 to an ink jet printer 1.

To begin with, at S110, whether or not the record mode preset by the user is the double-sided record mode is determined.

If it is determined that the record mode is not the double-sided record mode (NO), print on the second side (back) of the record paper 2 is not required and thus the process proceeds to S120 and S120 and the later steps are executed as in the first embodiment.

On the other hand, if it is determined at S110 that the record mode is the double-sided record mode (YES), the process proceeds to S170 and a droplet counter 65*a* and a counter 65*b* in an ASIC 65 are reset. This means that the previous counted number of ejected ink droplets is reset.

Next, at S400, image information is read from RAM 64 and whether or not one-page image information, namely, one-page print data has been stored in the RAM 64 is determined. If one-page print data is stored (YES), the process proceeds to S700; if one-page print data is not stored (NO), a wait state is entered until one-page print data is stored in the RAM 64 through an interface (I/F) 86 from an external personal computer (not shown) or an external image reader (not shown). After one-page print data is stored in the RAM 64, the process proceeds to S700.

Next, at S700, whether or not the one-page print data stored in the RAM 64 is the print data of the last page is determined. If it is determined that the print data is the print data of the last page (YES), the process proceeds to S860 and one sheet of record paper 2 stacked on a paper feed tray 3 is fed into a cabinet 31 of the ink jet printer 1. Next, at S870, a head control section 67 and a motor control section 68 are controlled and one page of the last page is printed on the first side of the record paper 2. Next, at S880, the record paper 2 is passed through a transport passage F in the cabinet 31 of the ink jet printer 1 and is ejected to an ejection tray 20. Then, the control procedure is terminated.

On the other hand, if it is determined at S700 that the print data is not the last page (NO), the process proceeds to S710 and one sheet of record paper 2 stacked on the paper feed tray 3 is fed into the cabinet 31 of the ink jet printer 1.

Next, at S720, while one page is printed on the first side of the record paper 2, the number of ejected ink droplets is counted by the droplet counter 65*a*. That is, ink is ejected onto the face of the record paper 2 through a print head 8 to print one page, and the number of ejected ink droplets from the print head 8 is counted by the droplet counter 65*a* based on the number of ink ejection signals input to the print head 8 by the ASIC 65. The counting unit executes S720.

Next, at S730, the number of ejected ink droplets counted by the droplet counter 65*a* is compared with a predetermined value to determine whether or not the number of ejected ink droplets exceeds the predetermined value. The comparison unit 6204 executes S730.

Next, if the number of ejected ink droplets does not exceed the predetermined value (NO), the process proceeds to S740; if the number of ejected ink droplets exceeds the predetermined value (YES), the process proceeds to S890. That is, if the number of ejected ink droplets onto the first side (surface) of the record paper 2 exceeds the predetermined value to determine whether or not double-sided record is enabled, it is determined that double-sided record is disabled, and the process proceeds to S890. On the other hand, if the number of ejected ink droplets onto the first side (surface) of the record paper 2 does not exceed the predetermined value, it is determined that double-sided record is enabled, and the process proceeds to S740. The determination unit 6206 executes S730.

If the number of ejected ink droplets onto the first side (surface) of the record paper 2 does not exceed the predetermined value (NO) at S730, the process proceeds to S740 and whether or not the print data of the next page is stored in the RAM 64 is determined. If the print data of the next page (second side) is not stored in the RAM 64 (NO), a wait state is entered until the print data of the next page is input to the RAM 64 through the interface (I/F) 86 from the external personal computer (not shown) or the external image reader (not shown). When the print data of the next page has been stored (YES), the process proceeds to S750.

At S750, the print data of the next page (on/off information of dots) stored in a predetermined area in the RAM 64 is read and the number of ejected ink droplets required for printing on the second side of the record paper 2 is counted by the counter 65*b*. The second-side counting unit 6210 executes S750.

Next, at S760, the number of ink droplets to be ejected onto the second side (back) of the record paper 2 counted at S750 is compared with the predetermined value to determine whether or not the number of ink droplets to be ejected exceeds the predetermined value. If the number of ink droplets to be ejected exceeds the predetermined value (YES), it is determined that record on the second side of the record paper 2 is disabled, and the process proceeds to S770. That is, although it is determined at S730 that double-sided record is enabled, the determination is canceled at S760. The cancel unit 6212 executes S760.

Next, at S770, whether or not the record paper 2 is paper dedicated to double-sided record is determined. If it is not determined at S770 that the record paper 2 is paper dedicated to double-sided record (NO), the process goes to S780 and the record paper 2 is passed through the transport passage F in the cabinet 31 of the ink jet printer 1 and is ejected to the ejection tray 20. Next, at S790, one sheet of record paper 2 stacked on the paper feed tray 3 is fed into the cabinet 31 of the inkjet printer 1. Next, at S800, the head control section 67 and the motor control section 68 are controlled and print is executed on the record paper 2 based on the print data of the next page. Further, at S840, the record paper 2 is ejected to the ejection tray 20.

Next, at S850, whether all pages have been printed is determined. If it is determined that all pages have been printed (YES), the control procedure of the record operation terminates. If it is not determined that all pages have been printed (NO), the process returns to S170.

On the other hand, if it is determined at S770 that the record paper 2 is paper dedicated to double-sided record (YES), the process proceeds to S810 to print on the second side of the record paper 2. If the number of ink droplets to be ejected onto the second side (back) of the record paper 2 counted at S750 does not exceed the predetermined value (NO) at S760, the process also proceeds to S810.

Next, at S810, the record paper 2 is reversed through transport passages G and H in the cabinet 31 of the ink jet printer 1 and again is transported to a record position P. Next, at S820, ink is ejected onto the face of the record paper 2 through the print head 8 for printing one page (next page) on the second side of the record paper 2. Next, at S830, the record paper 2 is again reversed through the transport passages G and H and then S840 and the later steps are executed as described above.

On the other hand, if it is determined at S730 that the number of ejected ink droplets onto the first side (surface) of the record paper 2 exceeds the predetermined value (YES), the process proceeds to S890 and whether or not the record paper 2 is paper dedicated to double-sided record is determined. If the record paper 2 is paper dedicated to double-sided record (YES), the process proceeds to S900. That is, if it is determined at S890 that the record paper 2 is paper dedicated to double-sided record, the result of determining that print on both sides is disabled at S730 is invalidated, and the procedure of printing on both sides of the record paper 2 is executed. The invalidation unit 6214 executes S890.

Next, at S900, whether or not the print data of the next page is stored in the RAM 64 is determined. If the print data of the next page is stored (YES), the process proceeds to S810 and S810 and the later steps are executed. On the other hand, if the print data of the next page is not stored (NO), a wait state is entered until the print data of the next page is input to the RAM 64 through the interface (I/F) 86 from the external personal computer (not shown) or the external image reader (not shown). After the print data is stored, the process proceeds to S810.

On the other hand, if it is not determined at S890 that the record paper 2 is paper dedicated to double-sided record (NO), the process proceeds to S910 and the record paper 2 is passed through the transport passage F in the cabinet 31 of the ink jet printer 1 and is ejected to the ejection tray 20.

Next, at S920, whether or not one-page print data is stored in the RAM 64 is determined. If it is determined that the print data of the next page is stored (YES), the process proceeds to S930. If it is determined that the one-page print data is not stored (NO), a wait state is entered until the print data of the next page is input to the RAM 64 through the interface (I/F) 86 from the external personal computer (not shown) or the external image reader (not shown). After the print data is stored, the process proceeds to S930.

Next, at S930, one sheet of record paper 2 stacked on the paper feed tray 3 is fed into the cabinet 31 of the ink jet printer 1. Next, at S940, the head control section 67 and the motor control section 68 are controlled and one page is printed. Next, the process proceeds to S840 and S840 and the later steps are executed as described above.

According to the fifth embodiment of the invention, as shown in FIG. 7, at step S720, while one page is printed, the number of actually ejected ink droplets is counted by the droplet counter 65*a* and at S730, the number of ejected ink droplets is compared with the predetermined value to determine whether or not double-sided record is enabled. Thus, when ink is ejected to both sides of the record paper 2 to form images, images can be provided with high image quality. The presence or absence of back reflection can be precisely determined for various images and whether or not double-sided record is enabled can be effectively determined.

At S750, before the next page of the record paper 2 (the back of the first page) is printed, the number of ink droplets to be ejected onto the next page of the record paper 2 is counted and if it is determined at S730 that double-sided print is enabled, based on the number of ejected ink droplets counted at S750, the number of ejected ink droplets is compared with the predetermined value at S760 to again determine whether or not double-sided record is enabled. Thus, high-quality images can be efficiently formed on both sides of the record paper 2 without impairing the quality of the images on both sides of the record paper 2 as the number of ejected ink droplets onto the second side of the record paper 2 is large.

Whether or not the record paper 2 is paper dedicated to double-sided record is determined at S770, S890. If the record paper 2 is paper dedicated to double-sided record, even if it is determined that double-sided record is disabled as the result of comparing the number of ejected ink droplets with the predetermined value at S730, S760, print on both sides is enabled. Thus, high-quality images can be formed on both sides of the record paper 2 conforming to the type of record paper 2.

(Sixth Embodiment)

Figure 8:
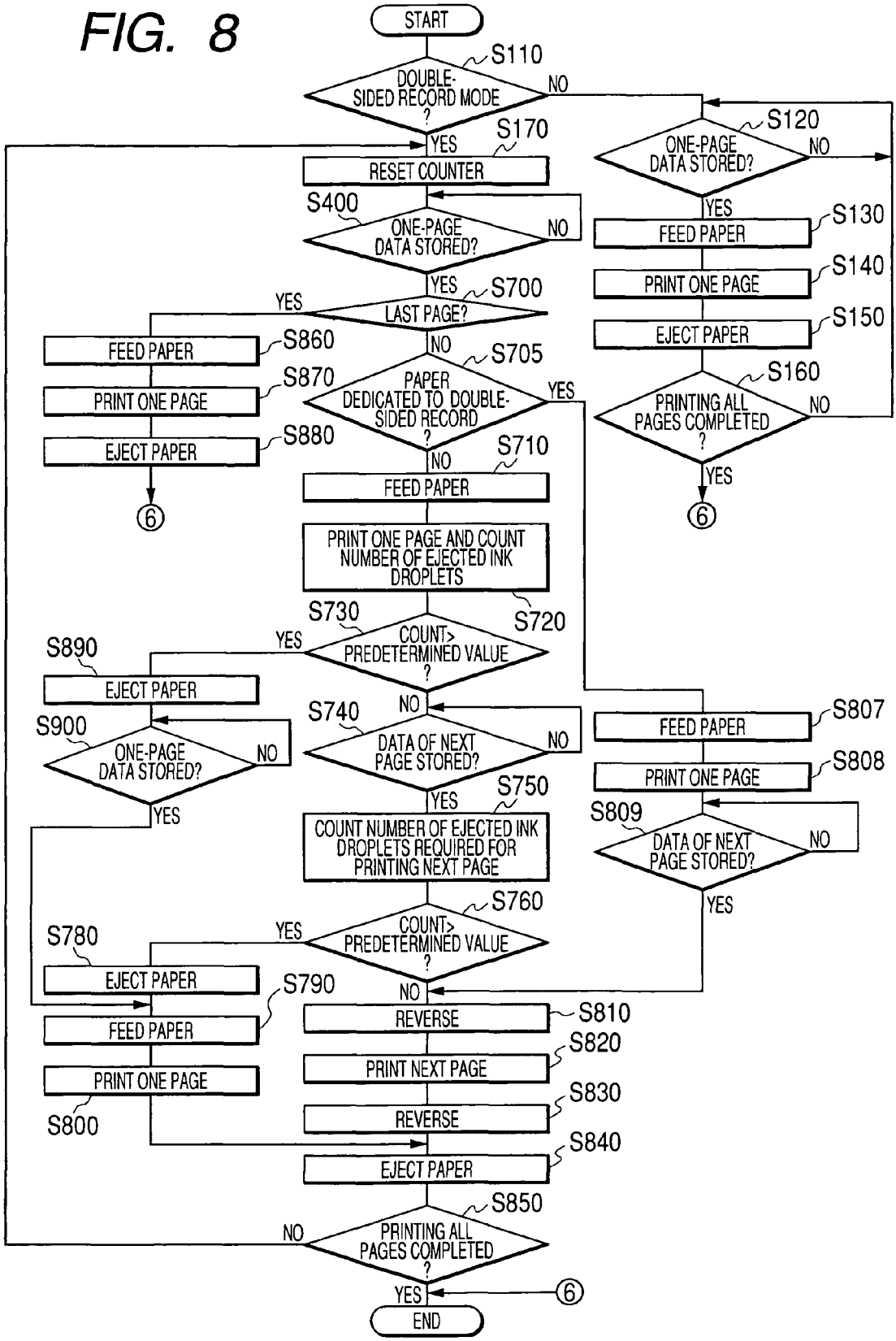
FIG. 8 is a flowchart to represent a processing procedure of record operation in a sixth embodiment of the invention.

Next, the processing procedure of record operation in a sixth embodiment of the invention will be discussed with a flowchart of FIG. 8. In the following processing procedure, it is assumed that the user previously operates an operation panel 84 to specify counting the number of ejected ink droplets separately on each page of both sides of record paper 2 as a predetermined area in which the number of ejected ink droplets is counted. Further, it is assumed that the user operates the operation panel 84 to preset double-sided record mode or single-sided record mode as the record mode and the type of record paper 2. The main steps in the sixth embodiment are similar to those in the fifth embodiment previously described with reference to the flowchart of FIG. 7 and therefore the common part will not be discussed again in detail and the characteristic part will be discussed below:

As the processing procedure of the record operation on the record paper 2, the control procedure shown in the flowchart of FIG. 8 is started when the user gives a command for recording on the record paper 2 to an ink jet printer 1.

To begin with, at S110, whether or not the record mode preset by the user is the double-sided record mode is determined.

If it is determined that the record mode is not the double-sided record mode (NO) at S110, print on the second side (back) of the record paper 2 is not required and thus the process proceeds to S120 and S120 and the later steps are executed as in the first embodiment.

On the other hand, if it is determined at S110 that the record mode is the double-sided record mode (YES), the process proceeds to S170 and a droplet counter 65*a* and a counter 65*b* in an ASIC 65 are reset.

Next, at S400, image information is read from RAM 64 and whether or not one-page image information, namely, one-page print data has been stored in the RAM 64 is determined. If one-page print data is stored (YES) at S400, the process proceeds to S700; if one-page print data is not stored (NO), await state is entered until one-page print data is stored in the RAM 64 through an interface (I/F) 86 from an external personal computer (not shown) or an external image reader (not shown). After one-page print data is stored in the RAM 64, the process proceeds to S700.

Next, at S700, whether or not the one-page print data stored in the RAM 64 is the print data of the last page is determined. If it is determined that the print data is the print data of the last page (YES), the process proceeds to S860 and S860 and the later steps are executed as in the fifth embodiment.

On the other hand, if it is determined that the print data is not the last page (NO), the process proceeds to S705 and whether or not the record paper 2 is paper dedicated to double-sided record is determined. If it is determined that the record paper 2 is paper dedicated to double-sided record (YES), the process proceeds to S807 and one sheet of record paper 2 stacked on a paper feed tray 3 is fed into a cabinet 31 of the ink jet printer 1. Next, at S808, a head control section 67 and a motor control section 68 are controlled and one page is printed. Next, at S809, whether or not the print data of the next page is stored in the RAM 64 is determined. If the print data of the next page is stored (YES), the process proceeds to S810. If the print data of the next page is not yet stored (NO), a wait state is entered until the print data of the next page is input to the RAM 64 through the interface (I/F) 86 from the external personal computer (not shown) or the external image reader (not shown). After the print data of the next page is stored, the process proceeds to S810. Then, S810 and the later steps are executed as in the fifth embodiment.

On the other hand, if it is determined at S705 that the record paper 2 is not paper dedicated to double-sided record (NO), the process proceeds to S710 and one sheet of record paper 2 stacked on the paper feed tray 3 is fed into the cabinet 31 of the inkjet printer 1. Next, at S720, while print is executed on the first side of the record paper 2 based on the one-page print data, the number of ejected ink droplets from a print head 8 is counted by the droplet counter 65*a*.

Next, at S730, the number of ejected ink droplets counted by the droplet counter 65*a* is compared with a predetermined value to determine whether or not the number of ejected ink droplets exceeds the predetermined value. If the number of ejected ink droplets does not exceed the predetermined value (NO), the process proceeds to S740 and S740 and the later steps are executed as in the fifth embodiment.

On the other hand, if the number of ejected ink droplets exceeds the predetermined value (YES) at S730, the process proceeds to S890 and the record paper 2 is passed through a transport passage F in the cabinet 31 of the ink jet printer 1 and is ejected to an ejection tray 20. Next, at S900, image information is read from the RAM 64 and whether or not one-page image information, namely, one-page print data has been stored in the RAM 64 is determined. If one-page print data is stored (YES), the process proceeds to S790; if one-page print data is not stored (NO), a wait state is entered until one-page print data is stored in the RAM 64 through the interface (I/F) 86 from the external personal computer (not shown) or the external image reader (not shown). After one-page print data is stored in the RAM 64, the process proceeds to S790.

Next, at S790, one sheet of record paper 2 stacked on the paper feed tray 3 is fed into the cabinet 31 of the ink jet printer 1. Next, at S800, the head control section 67 and the motor control section 68 are controlled and print is executed on the first side of the record paper 2 based on one-page print data. Next, the process proceeds to S840 and the record paper 2 is ejected through the transport passage F to the ejection tray 20. Next, at S850, whether all pages have been printed is determined. If it is determined that all pages have been printed (YES), the control procedure of the record operation terminates. If it is not determined that all pages have been printed (NO), the process returns to S170.

According to the sixth embodiment of the invention, as shown in FIG. 8, whether or not the record paper 2 is paper dedicated to double-sided record is determined at S705. If the record paper 2 is paper dedicated to double-sided record, it is assumed that double-sided record can be executed regardless of the number of ejected ink droplets, and the process proceeds to S807. Double-sided record is enabled without counting the number of ejected ink droplets to the record paper 2. Thus, high-quality images can be provided on both sides of the record paper 2 conforming to the type of record paper 2, and the load for counting the number of ejected ink droplets can be decreased.

If the record paper 2 is not paper dedicated to double-sided record, at S720, while one page is printed, the number of ejected ink droplets onto the first side of the record paper 2 is counted and at S730, the number of ejected ink droplets is compared with the predetermined value to determine whether or not double-sided record is enabled. Thus, if ink is ejected to both sides of the record paper 2 to form images, high-quality images can be provided without impairing the image quality.

If it is determined at S730 that double-sided print is enabled, before print is executed on the second side of the record paper 2, the number of ink droplets to be ejected onto the second side of the record paper 2 is previously counted at S750 and the number of ejected ink droplets is compared with the predetermined value at S760 to again determine whether or not double-sided record is enabled. Thus, high-quality images can be efficiently formed on both sides of the record paper 2 without impairing the quality of the images on both sides of the record paper 2 as the number of ejected ink droplets onto the second side of the record paper 2 is large.

According to the first to sixth embodiments described above, the area in which the number of ejected ink droplets is counted on the record paper 2 is one page of the first side and one page of the second side of the record paper 2, but the user can previously operate the operation panel 84 to set various modes.

Figure 9:
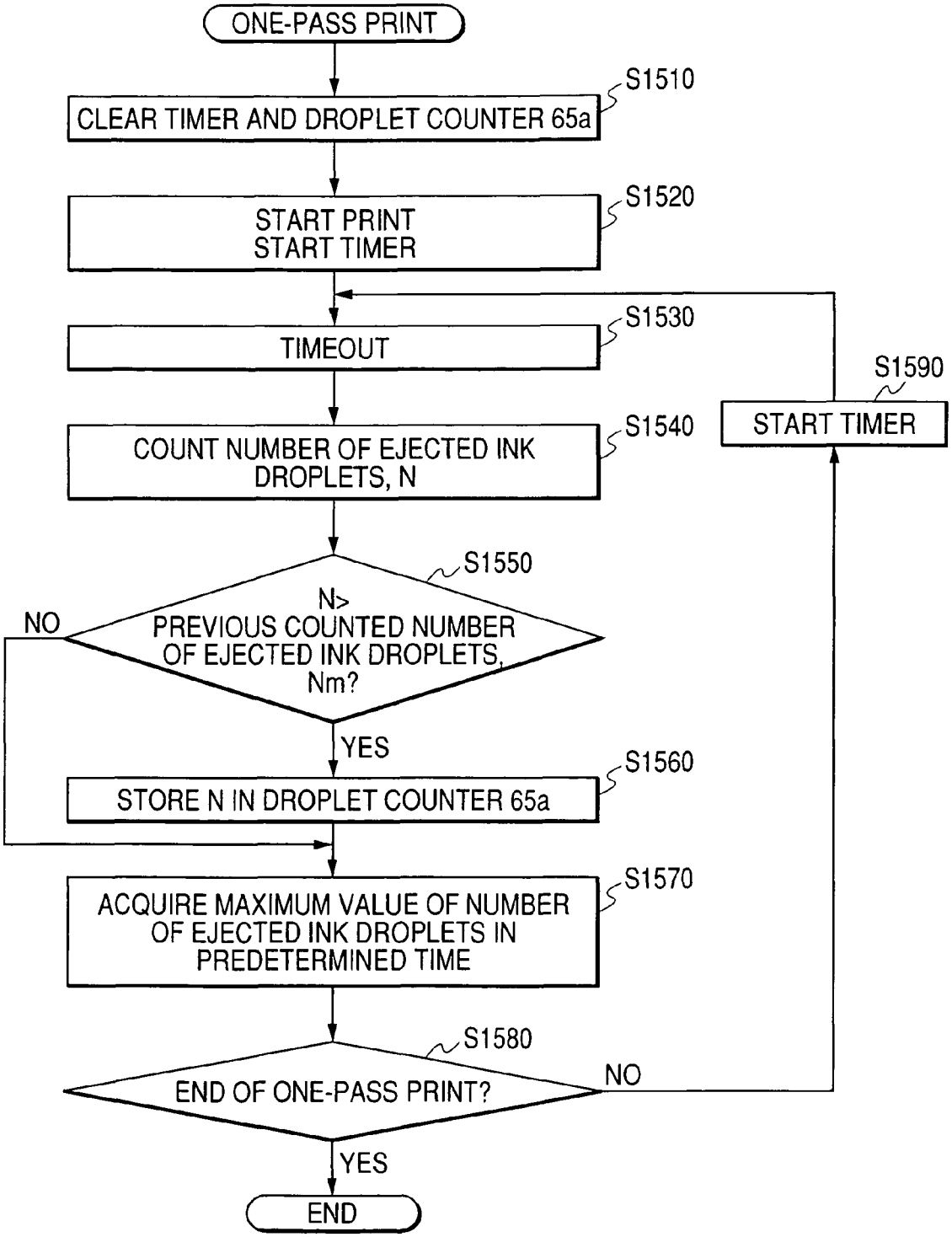
FIG. 9 is a flowchart to represent a processing procedure of one-pass record operation in a modification.

For example, as shown in FIG. 9, the user can operate the operation panel 84 to specify a one-pass area in which the print head 8 moves in one pass in the main scanning direction relative to the record paper 2 as the area in which the number of ejected ink droplets is counted. Further, to count the number of ejected ink droplets in the one-pass area, whenever the print head 8 moves relatively to the record paper 2 within a predetermined time, the number of ejected ink droplets is counted and the maximum value of the number of ejected ink droplets counted every predetermined time can be specified as the number of ejected ink droplets in the one-pass area. Next, the processing procedure of record operation in a modification will be discussed with a flowchart of FIG. 9.

To begin with, at S1510, a timer is cleared and a droplet counter 65*a* containing the previous count is reset. In the modification, the timer is used to count the number of ejected ink droplets within a predetermined time. Next, at S1520, a head control section 67 and a motor control section 68 are controlled and the print operation of a print head 8 in the main scanning direction is started and the timer is started. At S1530, when the predetermined time set in the timer is reached, the operation of the timer is interrupted. At S1540, the number of ejected ink droplets from the print head 8 during the operation of the timer, N, is counted. Next, at S1550, whether or not the number of ejected ink droplets, N, is greater than the previous counted number of ejected ink droplets, Nm, counted by and stored in the droplet counter 65*a* is determined. The number of ejected ink droplets, Nm, stored in the droplet counter 65*a* is zero just after the droplet counter 65*a* is cleared at S1510. If the number of ejected ink droplets, N, is greater than the previous counted number of ejected ink droplets, Nm, (YES), the process proceeds to S1560 and the count of the droplet counter 65*a* is overwritten with the number of ejected ink droplets, N, counted at S1540. At S1570, the value is stored as the maximum value Nm of the number of ejected ink droplets counted every predetermined time. On the other hand, if the number of ejected ink droplets, N, is less than the previous counted number of ejected ink droplets, Nm, (NO), the process proceeds to S1570 and the previous counted number of ejected ink droplets is stored intact as the maximum value Nm of the number of ejected ink droplets counted every predetermined time. The counting unit 6202 executes S1520 to S1570. Next, at S1580, whether or not the one-pass print is complete is determined. If it is not determined at S1580 that the one-pass print is complete (NO), the process proceeds to S1590 at which the timer is again started. Then, S1530 to S1580 are repeated. On the other hand, if it is determined at S1580 that the one-pass print is complete (YES), the maximum value Nm of the number of ejected ink droplets in the one-pass print is stored in the droplet counter 65*a* and the one-pass print terminates. When S1510 and the later steps are repeated and one-page print is complete, the maximum value Nm of the number of ejected ink droplets in the one-pass print may be compared with a predetermined value to determine whether or not double-sided record is enabled for determining whether or not double-sided record is enabled.

According to the modification previously described with reference to FIG. 9, the number of ejected ink droplets per predetermined time during the one-pass print operation wherein the print head 8 moves in one pass in the main scanning direction is counted and whether or not double-sided record is enabled is determined. Thus, when double-sided record is executed, the image quality is not locally impaired. Since the area in which the print head 8 moves only in one pass in the predetermined direction (main scanning direction) relative to the record paper 2 is adopted as the area in which the number of ejected ink droplets is counted, a high-quality image can be provided without impairing the image quality because of local osmosis of ink into the record paper 2. Further, since the area in which the print head 8 moves within the predetermined time relative to the record paper 2 is adopted as the area in which the number of ejected ink droplets is counted, if the ejected ink amount per predetermined time is imbalancedly large, whether or not double-sided record is enabled can be determined with accuracy. When double-sided record is executed, high-quality images can be provided without impairing the image quality.

The area in which the number of ejected ink droplets is counted on the record paper 2 can be set not only as one page of the first side and one page of the second side of the record paper 2 or the one-pass area, but also as the area in which the print head 8 moves relatively only at a predetermined distance in a predetermined direction of the print paper 2. At the time, the move distance of the print head 8 may be detected by the linear encoder 15 and when the move distance reaches the predetermined move distance, the number of ejected ink droplets may be counted. Accordingly, the record area on the record paper 2 and the area in which the number of ejected ink droplets is actually counted can be matched with each other with accuracy for effectively determining whether or not double-sided record of the record paper 2 is enabled.

According to the first to sixth embodiments, the user previously operates the operation panel 84 to specify whether nor not record paper is paper dedicated to double-sided record. However, when the record paper 2 is fed into the cabinet 31 of the ink jet printer 1, the reflection optical sensors 21*a* and 21*b* placed in the cabinet 31 of the ink jet printer 1 may be used to determine the type of record paper 2 and when it is determined that the record paper 2 is paper dedicated to double-sided record, it may be determined that double-sided record is enabled without counting the number of ejected ink droplets.

To determine whether or not double-sided record is enabled, whenever the print head 8 moves a predetermined distance, the number of ejected ink droplets may be counted and the record density (representing the number of ejected ink droplets per unit area on record paper) may be counted. When the area exceeding a predetermined record density exceeds a given value, it may be determined that double-sided record on the record paper 2 is disabled. Accordingly, a high-quality image can be provided without impairing the image quality because of local osmosis of ink.

If the record paper 2 is record paper of the type wherein the ink absorption speed is low, delay of the print start time of the next page may be controlled so as to delay the start time until recording on the second side of the print paper 2 after printing on the first side.

Ejection switching means for switching the amount of one droplet ejected from the print head 8 may be provided so that the predetermined value in the comparison unit 6204 can be selected based on switching of the ejection switching means. Accordingly, whether or not double-sided record is enabled can be determined more accurately.

Figure 11:
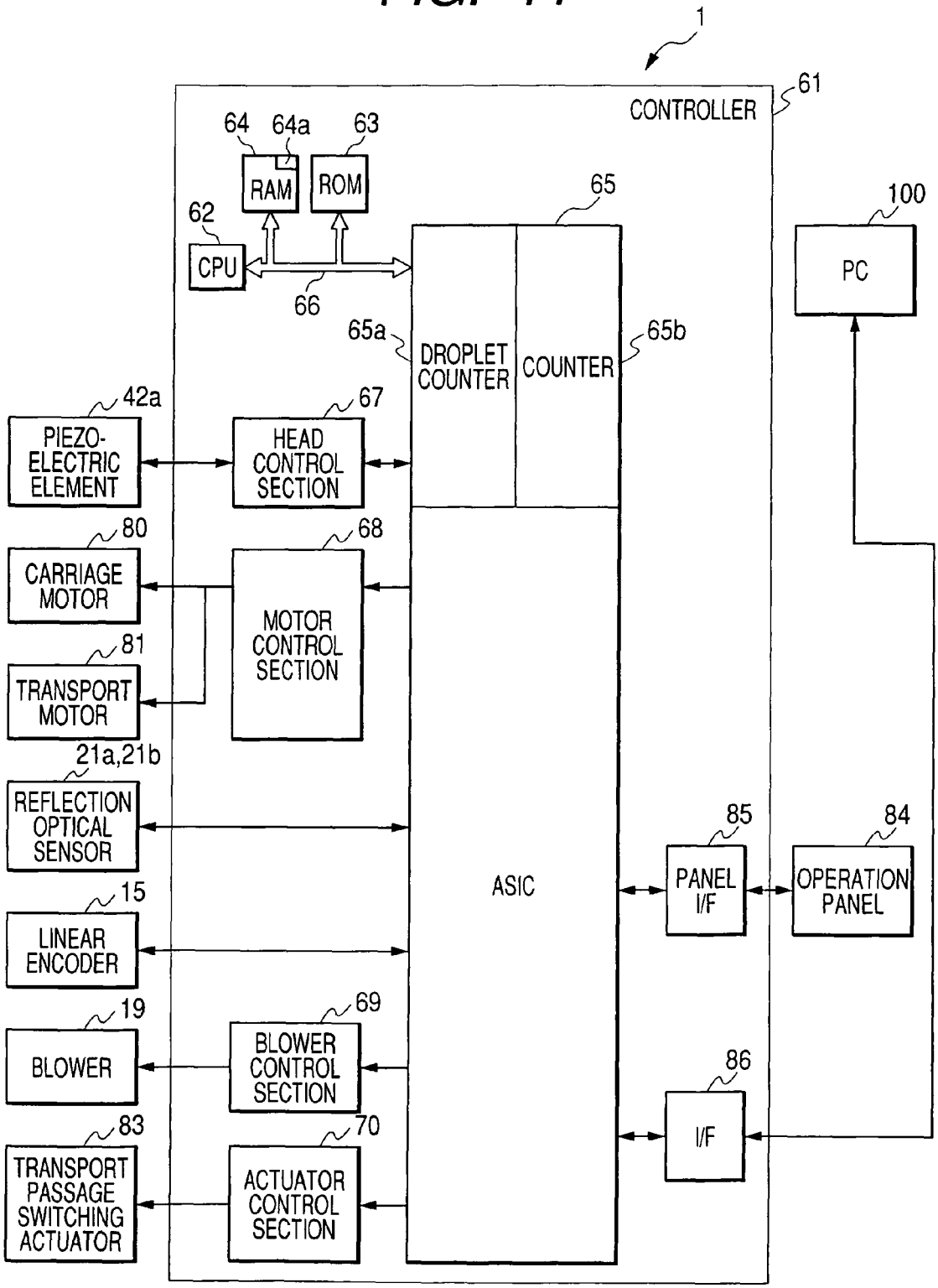
FIG. 11 is a block diagram showing a modification of the embodiments.

Incidentally, the inkjet printer 1 may be connected to a PC 100 as shown in FIG. 11. In the configuration shown in FIG. 11, the PC 100 may execute the processing that is executed in the control unit 61 in the first to sixth embodiment. That is, the PC 100 may provide functions equivalent to that of a counting unit 6202, a comparison unit 6204, a determination unit 6206, an area specification unit 6208, a second-side counting unit 6210, a cancel unit 6212, an invalidation unit 6214, a count stop unit 6216, and a print delay unit 6218, shown in FIG. 10. In addition, the PC 100 may be substituted by another device having a CPU, such as a digital camera.

Figure 12:
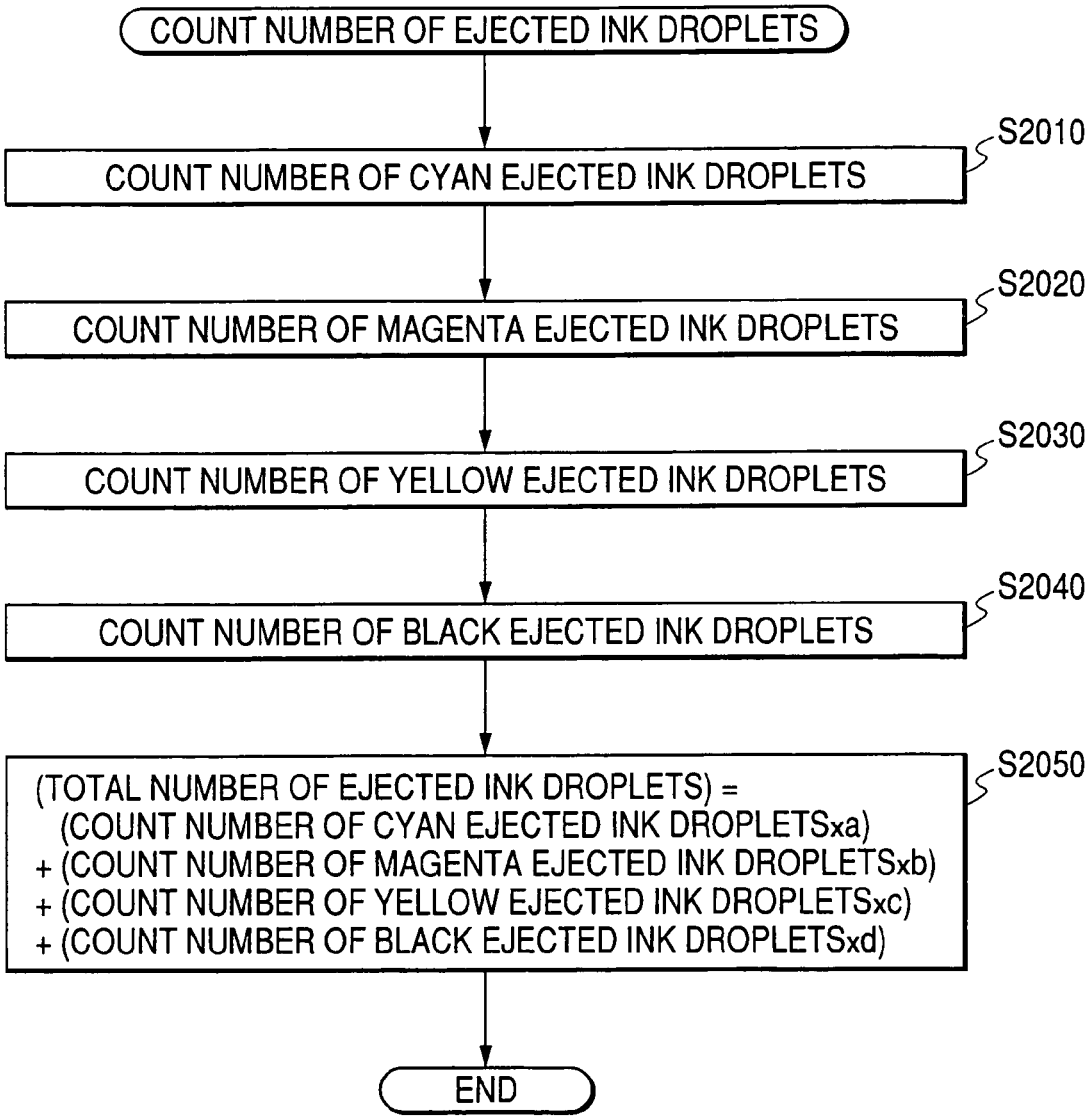
FIG. 12 is a flowchart showing a processing procedure of counting the number of ink droplets according to a modification of the embodiments.

Incidentally, in the above embodiments, the number of ejected ink droplets is counted as it is, without taking colors of the image into consideration. Instead, the number of ink droplets may be counted per color and respectively weighted according to brightness of the colors. FIG. 12 shows an example flowchart when the total number of ink droplets is calculated while counting the number of ink droplets per color and weighting the counted ink droplets numbers. In step 2010, the print data stored in the RAM 64 is read and the number of ejected cyan ink droplets required for printing on the face of the record paper 2 for each page is counted. Next, in step 2020, the number of ejected magenta ink droplets required for printing on the face of the record paper 2 for each page is counted. Similarly, in steps 2030 and 2040, the numbers of ejected yellow and black ink droplets for print are respectively counted. In step 2050, the counted number for each color is weighted by multiplying the counted number by each of weight coefficients a-d, which are respectively determined according to brightness of the colors. Then, the weighted numbers are summed to obtain the total number of the ejected ink droplets, which is to be compared with the predetermined value at the step S200, S420, S730 or S760.

Incidentally, in the above embodiments, the number of ejected ink droplets are compared with a predetermined value. The predetermined value may be either constant or variable. The predetermined value may be changed according to a type of image to be formed on the face of the record paper 2, such as text, picture, and color used for the image. Specifically, the ROM 63 or the RAM 64 may store a plurality of different predetermined values corresponding to colors and the CPU 62 may read one of the predetermined values according to the color of images to be formed.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

What is claimed is:

1. An image forming apparatus, comprising:

a print unit that ejects ink onto a face of a record medium to form an image thereon;

a counting unit configured to count a number of ink droplets based on on/off information of dots included in print data corresponding to a predetermined area of the record medium;

a reference setting unit configured to set a reference value according to a type of image to be formed on the face of the record medium; and a determination unit configured to determine whether double-sided print on the record medium is enabled based on a comparison result between the reference value and the number counted by the counting unit.

2. The image forming apparatus as claimed in claim 1, wherein the type of image includes colors of the image.

3. The image forming apparatus as claimed in claim 1, wherein the type of image includes text and picture.

4. The image forming apparatus as claimed in claim 1, wherein the counting unit is configured to count the number of ink droplets for a front page and a back page of the record medium before the determination unit determines whether the double-sided print on the record medium is enabled.

5. A print system, comprising:

a print unit that ejects ink onto a face of a record medium to form an image thereon;

a counting unit configured to count a number of ink droplets based on on/off information of dots included in print data corresponding to a predetermined area of the record medium;

a reference setting unit configured to set a reference value according to a type of image to be formed on the face of the record medium; and a determination unit configured to determine whether double-sided print on the record medium is enabled based on a comparison result between the reference value and the number counted by the counting unit.

6. The print system as claimed in claim 5, wherein the counting unit is configured to count the number of ink droplets for a front page and a back page of the record medium before the determination unit determines whether the double-sided print on the record medium is enabled.

* * * * *